US012672744B2

(12) United States Patent
Hildersley et al.

(10) Patent No.: US 12,672,744 B2
(45) Date of Patent: Jul. 7, 2026

(54) TABLETOP FOLDED SHEET DISPENSER

(71) Applicant: Essity Hygiene and Health Aktiebolag, Gothenburg (SE)

(72) Inventors: Catherine Mary Hildersley, Boston, MA (US); Evan Alton Hutker, Boston, MA (US); John P. Devlin, Boston, MA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 196 days.

(21) Appl. No.: 18/580,348

(22) PCT Filed: Jul. 19, 2021

(86) PCT No.: PCT/EP2021/070127
§ 371 (c)(1),
(2) Date: Jan. 18, 2024

(87) PCT Pub. No.: WO2023/001358
PCT Pub. Date: Jan. 26, 2023

(65) Prior Publication Data

US 2024/0341545 A1 Oct. 17, 2024

(51) Int. Cl.
*G07F 17/42* (2006.01)
*A47K 10/42* (2006.01)
(Continued)

(52) U.S. Cl.
CPC .... *A47K 10/422* (2013.01); *A47K 2010/3233* (2013.01)

(58) Field of Classification Search
CPC ..... A47K 10/422; A47K 10/427; A47K 2010/3233; A47K 2010/3246
See application file for complete search history.

(56) References Cited

U.S. PATENT DOCUMENTS 3,793,756 A * 2/1974 Kay ..... G09F 23/00 D34/1
7,527,170 B2 * 5/2009 Slocum ..... B60R 11/00 221/45

(Continued)

OTHER PUBLICATIONS

Chinese Office Action; Application No. 202180100721.8, filed Jul. 19, 2021; mailed Sep. 12, 2025, 34 pages, with English Abstract.

(Continued)

*Primary Examiner* — Gene O Crawford
*Assistant Examiner* — Kelvin L Randall, Jr.
(74) *Attorney, Agent, or Firm* — CANTOR COLBURN LLP

(57) ABSTRACT

Disclosed is a method for loading a stack of sheet material into a dispenser, the method including moving a lid of the dispenser from a closed use position into an open refilling position, the dispenser including a body having side walls, a base, an opening, the lid covering the opening, wherein the lid has a dispensing opening to enable sheet material to be dispensed therefrom, a platform for supporting a plurality of sheet material from below, wherein the platform is movable from a lowermost position to an uppermost position adjacent the lid, a biasing means for urging the platform towards the lid, a releasable locking mechanism for holding the platform in a locking position in the lowermost position, the releasable locking mechanism including a first pair of first arms movably attached to one of the side walls.

22 Claims, 10 Drawing Sheets

(51) Int. Cl.

| | |
|---|---|
| ***G07C 15/00*** | (2006.01) |
| ***G07F 17/32*** | (2006.01) |
| *A47K 10/32* | (2006.01) |

(56) References Cited

U.S. PATENT DOCUMENTS

| | | | | |
|---|---|---|---|---|
| 10,980,377 | B1 | 4/2021 | Falk et al. | |
| 2002/0030045 | A1* | 3/2002 | Nakamura | A47K 10/422 219/521 |
| 2006/0027593 | A1 | 2/2006 | Slocum | |
| 2006/0273100 | A1* | 12/2006 | Cittadino | A47K 10/426 221/33 |
| 2007/0138263 | A1* | 6/2007 | Tocher | G07D 11/13 235/381 |
| 2014/0319164 | A1 | 10/2014 | Wilson et al. | |
| 2018/0116473 | A1* | 5/2018 | Chalko | A47K 10/422 |
| 2020/0024073 | A1* | 1/2020 | Ferrara | B65F 1/1615 |
| 2020/0196810 | A1* | 6/2020 | Dallaire | A47K 10/422 |
| 2021/0007561 | A1* | 1/2021 | McNulty | A47K 10/422 |
| 2021/0204765 | A1* | 7/2021 | Falk | A47K 10/422 |

OTHER PUBLICATIONS

International Search Report & Written Opinion for International Application No. PCT/EP2021/070127; International Filing Date: Jul. 19, 2021; Date of Mailing: May 17, 2022; 20 pages.

Request for Additional Search for International Application No. PCT/EP2021/070127; International Filing Date: Jul. 19, 2021; Date of Mailing: Apr. 27, 2022; 4 pages.

* cited by examiner

TABLETOP FOLDED SHEET DISPENSER

CROSS REFERENCE TO RELATED APPLICATIONS

This application is a National Stage application of PCT/JP2021/070127, filed Jul. 19, 2021, which is incorporated by reference in its entirety herein.

TECHNICAL FIELD

The present disclosure relates to methods for loading sheet material, particularly sanitary paper sheet material such as hand towels, paper napkins, facials, or other wiping material in sheet form, into a dispenser for dispensing said sheet material. More particularly, the present disclosure relates to methods for loading sheet material into a tabletop folded sheet dispenser. The present disclosure further relates to systems including a dispenser and sheet material.

BACKGROUND

Sheet material is generally stacked and accommodated in a dispenser. The individual sheet material may be folded. Continuous dispensing of the folded sheet material from the dispenser is enabled by interfolding consecutive sheet material.

Napkins are one example of sheet material. Napkins in the form of sheets of material (e.g. tissue paper (ISO 12 625-1) or non-woven (ISO 9092)) intended for wiping and for hygienic purposes are common commercial items, for example, in restaurants or cafeterias, that may be provided in the form of stacks of napkins disposed in a dispenser having a dispensing opening from which individual napkins can be readily removed when needed. The dispenser for napkins should be easy to handle, should protect the napkins until use, and should be easy to move to a location where the napkins are needed, such as a table, a counter, or the like.

Interfolded napkins may be used. Interfolded napkins are sheets of materials arranged in a stack of superposed sheets, which are each folded at least once. The sheets are interlinked in such a way that the separate folded sheets of material form a chain of sheets in which each sheet has a leading panel and a trailing panel, the trailing panel being at least partly overlapped with the leading panel of the subsequent sheet in the stack. In this manner, the individual sheets are held loosely together by means of frictional forces arising between the overlapping parts. The sheets may be dispensed from a dispenser by pulling at the leading panel of the first sheet (leading sheet) in the stack. In this manner, the first sheet is extracted at the same time as a predetermined part of the leading panel of a subsequent sheet is fed into a dispensing position in the dispenser.

In many conventional dispenser types, a stack of sheet material accommodated in the dispenser is urged in a direction towards the dispensing opening. One type of such dispensers is a tabletop dispenser. A tabletop dispenser may be placed on top of a table, such as a table in a restaurant, and individual sheet material, such as a napkin, is withdrawn from the stack of sheet material from the top of the dispenser. In a tabletop dispenser, the stack of sheet material is usually supported by a movable platform from below, wherein the platform is urged upwards towards the dispensing opening by means of a spring or the like disposed below the platform.

Some dispensers have a lid or cover with a dispensing opening that restricts the width of the dispensed napkin in order to keep the leading panel of the next napkin to be dispensed from falling back into the dispenser. After all the napkins contained in the dispenser have been removed, the dispenser has to be refilled. For this purpose, the lid or cover is usually pivotably hinged to the body of the dispenser. Thus, the lid or cover may be opened giving access to the interior of the body for inserting a new stack of napkins.

In order to load an empty tabletop dispenser having the platform, the user removes or opens the lid of the dispenser in which the dispensing opening is provided, places the stack of sheet material on the platform and pushes down the stack (together with the platform) into the dispenser, whereby the user has to overcome the force exerted by the spring. In order to enable easy closing of the lid and avoid the spring ejecting the stack of sheet material, the platform is held in the lower position in the dispenser by means of a locking mechanism provided in the dispenser. The locking mechanism is releasable such that the stack of sheet material is urged towards the dispensing opening again once the lid is closed.

One problem with dispensers of this kind is that the platform is not always held in a horizontal orientation by the locking mechanism, parallel to the tabletop, but rather in a tilted position. Thus, the stack of sheet material is tilted to one side instead of having an upright orientation. In this case, when the locking mechanism is released, the stack of sheet material is not urged upwards towards the dispensing opening in an upright direction but rather in a tilted direction. Not only does this lead to the leading sheet material not being easily graspable anymore from the dispensing opening but also to an uneven force distribution across the stack of sheet material, thereby making it difficult to withdraw an individual sheet of material. Even further, it may not even be possible to close the lid properly if the stack of sheet material is held in a tilted position.

Hence, there is a need to improve the locking mechanism. This is, however, challenging because the locking mechanism is likely to be designed in a way not to interfere with the sheet material, while, at the same time, the space available for the sheet material should not be reduced and the overall size of the dispenser should not be increased excessively.

Further, tabletop dispensers may also be provided with transparent side walls which enable to use the dispensers for the arrangement of an advertisement sheet, a menu sheet, or the like.

In this context, the side walls of such known tabletop dispenser may be double walled having an inner wall and a transparent outer wall.

To arrange a new and/or different advertisement, menu, or the like at such a transparent outer wall, said commonly known dispensers have a transparent outer wall that can be opened to the outside.

However, this negatively affects the use of the dispenser because dust and dirt can gather inside the space defined between the two walls entering via gaps between the transparent outer wall and a housing body of the dispenser. Thus, the dust and dirt may be visible through the transparent side wall, which is detrimental to the appearance of the dispenser and included advertisement, menu, or the like.

Further, by having an outer wall that can be opened to the outside to include advertisements, menus, or the like may result in an unauthorized removal of the advertisement, the menu, or the like by patrons of the restaurant or cafeteria, for example.

Moreover, previously known dispensers do not only act as a dirt trap, but are also difficult to clean due to the gaps that open the space for advertisements, menus, or the like toward the outside.

Alternative previously known dispensers that are configured to illustrate an advertisement, a menu, or the like, are provided with a through-hole on an inner wall of a double-walled side wall, through which a user can put his finger in order to push the outer wall of the double-walled side wall to the outside and to thereby enable to open a space defined between the outer wall and the inner wall that may be used as a storing place for the advertisement, menu, or the like. By doing so, a new or different advertisement, menu, or the like can be inserted into the space and can be closed thereafter by pushing back the outer wall.

Yet, recesses to the outside remain and thereby provoke that such a dispenser may act as a dirt trap with regard to dust and/or dirt entering the dispenser from the outside, too. Additionally, the pushing of the outer wall via a finger of a user may pollute the transparent outer wall for displaying the advertisement, menu, or the like and may, therefore, provide a negatively affected appearance of such a dispenser and the corresponding advertisement, menu, or the like illustrated on its side wall.

Hence, there is a need to a dispenser that addresses the above-mentioned problems.

SUMMARY

In view of the above problems, it is an object of the present disclosure to provide a method for loading a stack of sheet material into a dispenser, in particular a tabletop dispenser, wherein the dispenser enables easy withdrawal of individual sheet material, while maintaining the space available for the sheet material. Further, it is an object of the present disclosure to provide a method for loading a stack of sheet material into a dispenser, in particular a tabletop dispenser, wherein the dispenser is easy to clean and prevents dirt from entering the dispenser from the outside to enable a highly qualitative appearance for advertisements, menus, or the like that are displayed at the side wall of the dispenser. Further, it is an object of the present disclosure to provide a system including a dispenser and sheet material with the above advantages.

The above-described problems are solved by the methods according to independent claims 1 and 11 and by the system according to independent claim 22. Preferred embodiments are set out in the dependent claims.

According to one aspect, there is provided a method for loading a stack of sheet material into a dispenser for dispensing said sheet material, the method including:

moving a lid of the dispenser from a closed use position into an open refilling position; the dispenser including: a body having four side walls, a base, e.g. for resting on a support surface, an opening in a top of the body, the lid being for covering the opening in use and enabling access to the opening for refilling, wherein the lid may be detachable for giving access to the opening, or, alternatively, wherein the lid may be movably attached to at least one of the side walls and may be sized to cover the opening, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a biasing means for urging the platform towards the lid, a releasable locking mechanism for holding the platform in a locking position in the lowermost position. The releasable locking mechanism includes a first pair of first arms movably attached to one of the side walls and extending in a direction from the top towards the base of the body, wherein each of the first pair of the first arms has a top end and a base end, a second pair of second arms movably attached to the base and extending in a direction from the side wall to which the first pair of the first arms is attached towards a center of the base, wherein each of the second pair of the second arms has a side wall end and a locking end, the side wall end being configured to cooperate with the respective base end of the respective first arm such that a movement of the first arm causes a movement of the second arm, the locking end being configured to releasably interlock with a respective locking portion of a pair of locking portions arranged at the platform to thereby hold the platform in the locking position, wherein the lid has a pair of engaging portions at its lower surface, wherein each of the pair of the engaging portions is configured to engage with the respective top end of the respective first arm upon closing the lid to thereby release the platform from the locking position;

placing the stack of sheet material via the opening with a trailing face of the stack of sheet material on a supporting surface of the platform;

exerting a force on a leading face of the stack of sheet material opposite to the trailing face to thereby push the platform into the body, in the locking position;

pivoting the lid from the open refilling position into the closed use position to thereby release the platform from the locking position; and extracting a portion of a leading sheet material from the leading face of the stack of sheet material through the dispensing opening of the lid, to thereby dispense the leading sheet material.

Since the releasable locking mechanism includes a first pair of first arms movably attached to one of the side walls and extending in a direction from the top towards the base of the body and a second pair of second arms movably attached to the base and extending in a direction from the side wall to which the first pair of the first arms is attached towards a center of the base, the locking mechanism extends along wall and base parts of the dispenser, thereby not occupying space of the interior of the dispenser intended for the sheet material. As a result, the space in the dispenser available for the stack of sheet material can be maintained. Moreover, since the second pair of the second arms extends towards the center of the base, where the respective locking ends interlock with the respective locking portions of the pair of the locking portions arranged at the platform, a locking connection between the second arms and the platform is established in a central area of the platform, thereby holding the platform in the locking position in a horizontal orientation. In this context, "horizontal orientation" may mean that the platform is oriented in parallel with the base of the dispenser. If the dispenser is placed on a tabletop, "horizontal orientation" may also imply that the platform is oriented in parallel with the tabletop. As a consequence, upon releasing the locking mechanism, the platform with the stack of sheet material placed thereon is urged towards the dispensing opening in an upright orientation, i.e. the stack of sheet material is urged towards the dispensing opening in a substantial vertical direction with respect to the base (and the tabletop). Hence, this configuration enables easy withdrawal of individual sheet material from the dispenser.

Moreover, by providing not only one first arm, one second arm, one locking portion, one engaging portion, but a pair of these components, the platform of the dispenser can be even more reliably held in the locking position in a horizontal orientation because two locking connections between the second arms and the platform is established in a central area of the platform, thereby enabling a more reliable urging of the platform and the stack of sheet material towards the dispensing opening in an upright orientation and, thus, easy withdrawal of individual sheet material.

Having such an arrangement is not obviously derivable by the person skilled in the art, as providing a pair of these components, at first sight, provokes a more complex system and requires a more precise coordination of the involved components. Moreover, such system would lead to higher costs in production.

In contrast, in state-of-the-art-dispensers, the platform is held in the locking position at one edge thereof by the locking mechanism. Since the biasing means for urging the platform towards the lid is usually arranged in a central area of the platform, this leads to a tilted orientation of the platform in the locking position. Thus, the stack of sheet material is not urged towards the dispensing opening in an upright orientation, but in a tilted orientation, thereby leading to the above-described problems.

The stack of sheet material may be a commercially available stack of sheet material for refilling a dispenser and may be sized to fit in the body of the dispenser.

The lid may be movably attached to at least one of the side walls by means of one or more hinges or the like. It is also conceivable, that the lid is attached to two of the side walls. In particular, the lid may be pivotably attached to the at least one of the side walls. Accordingly, the lid may be permanently attached to the body of the dispenser and may be tilted from an open refilling position to a closed use position. Such an arrangement ensures an easy and reliable closing and opening of the lid with respect to the body of the dispenser.

Alternatively, the lid may be configured to be reversibly removable and attachable to the body. In other words, the lid may be temporarily removable from the body of the dispenser and be re-attached thereto. This may allow for easier refilling of the dispenser, as the lid can temporarily be put aside.

The closed use position of the lid may be a position of the lid in which the lid fully closes the opening of the body so as to entirely cover the opening of the body. In this case, the sheet material is only accessible from the dispensing opening in the lid. The open refilling position may be defined as a position of the lid enabling refilling of the dispenser with sheet material. In particular, the open refilling position may be a position in which the lid is in a fully open position so that, when moving the stack of sheet material towards the platform of the dispenser, the stack of sheet material does not come into contact with the lid.

The dispensing opening in the lid may be formed as a slot, as known from prior art dispensers.

The dispensing opening in the lid may open to the top of the dispenser and the dispenser rests on the support surface via the base thereof. Accordingly, the sheet material may be dispensed along a vertical direction when the dispenser rests on a support surface via the base.

Yet, it may also be possible to arrange the described tabletop dispenser in an upright/flipped position, that is, in a position, in which the base extends in a vertical direction and the dispenser rests on one of the four side walls. Accordingly, also the lid, which opposes the base of the dispenser, may extend along the vertical direction, such that sheet material may be dispensed along a horizontal direction via the lid.

Thus, the base and/or at least one of the side walls may include an anti-slip protection to ensure a fixed position of the dispenser when resting on the base or on one of the side walls.

The lowermost position of the platform may be defined as the position of the platform in which the platform is held, via the locking ends of the second arms being interlocked with the locking portions of the platform, in the locking position. Since the biasing means urges the stack of sheet material towards the dispensing opening, the stack of sheet material may come into contact with the inner surface of the lid. Upon withdrawing the sheet material, the stack of sheet material is reduced in height such that the platform is moved upwards. Once the stack of sheet material only includes very little sheet material, for example, one to five individual sheets, the platform may be in the uppermost position adjacent the lid, in which a supporting surface of the platform for supporting the stack of sheet material may be disposed close to an upper end of the side walls, i.e. in substantially the same height.

The biasing means for urging the platform towards the lid may be a spring, in particular a coil spring.

The first arms of the first pair may have a mirror symmetric configuration in the dispenser, the second arms of the second pair may have a mirror symmetric configuration in the dispenser, the engaging portions may have a mirror symmetric configuration in the dispenser, and the locking portions may have a mirror symmetric configuration in the dispenser. Mirror symmetric in this regard may mean that it is possible to define a mirror symmetry axis with respect to the two parts concerned. Such configuration enables an even better horizontal orientation of the platform in the locking position, compared to state-of-the-art dispensers.

The first arms may have a flat shape so as not to protrude towards the interior of the dispenser in order not to interfere with the stack of sheet material and/or the platform. The first arms may be movable translationally and/or rotationally with respect to the side wall to which the first pair of the first arms is attached. The first arms may extend along the whole length of the side wall from the top towards the base of the body or along a substantial portion of the length of the side wall from the top towards the base of the body. The first arms may be provided at either one of the four side walls. The top end is the end of the arm located closer to the opening of the body than the other end of the first arm which is the base end.

The second arms may have a flat shape so as not to protrude towards the interior of the dispenser. The second arms may be movable translationally and/or rotationally with respect to the base of the body. The second arms extend in a direction from the side wall on which the first arm is attached towards a center of the base. In this context, extending towards the center of the base may mean that the general extension direction of the second arms is in a direction parallel to the base and substantially perpendicular to the side wall to which the first pair of the first arms is attached. Further, in this context, center of the base may mean the center point of the base but may also mean the central area or region of the base around the center point of the base. The side wall end of the second arms is the end located closer to the side wall to which the first pair of the first arms is attached than the other end of the second arms which is the locking end. In particular, the second arms may be disposed below the platform and above the base, i.e. between the platform and the base. This ensures that the second arms do not interfere with the stack of the sheet material.

As discussed above, the side wall end of the second arms are configured to cooperate with the base end of the first arms.

However, the side wall end and the base end are not necessarily coupled to each other or connected to each other in order to cooperate with each other, which has the advantage that they are free and easily replaceable. In this case, a movement of the first arm causes a movement of the second arm by the base end of the first arm coming into contact with the side wall end of the second arm.

The locking portions arranged at the platform may have the shape of a hook, in particular, the shape of a half arrow constituting a snap hook design. In this case, the locking ends of the second arms may be designed to be engageable with the snap hook, thereby interlocking with the locking portions of the platform. For example, the locking portions may approach and come into contact with the locking ends of the second arms upon moving the platform downwards towards the base. Then, the snap hook design of the locking portions may interlock with the locking ends of the second arms. In order to release the interlocked state, the second arms may be moved such that the locking ends of the second arms disengage from the locking portions of the platform.

The engaging portions at the lower surface of the lid are configured to engage with the top ends of the first arms upon closing the lid to thereby release the platform from the locking position. For example, the engaging portions may protrude from the lower surface of the lid in order to engage with the top ends of the first arms upon closing the lid. In another example, the engaging portions may be a lower wall portion of the lid. In this case, the top ends of the first arms may protrude from the side wall, to which the first arms are attached, in an upwards direction. Then, upon closing the lid, the lower wall portion of the lid constituting the engaging portions may come into contact with the top ends of the first arms, thereby causing a movement of the first arms. For example, the movement of the first arms may be a downward translational movement by pushing the engaging portions against the top ends of the first arms. The movement of the first arms may then cause a movement of the second arms by cooperation of the side wall ends of the second arms with the base ends of the first arms. Then, the locking ends of the second arms may disengage from the locking portions of the platform to thereby release the platform from the locking position. Hence, with this configuration, a releasable locking mechanism is established.

The trailing face of the stack of sheet material may be defined as a face of the stack of sheet material which faces the supporting surface when the stack of sheet material is placed on the platform. The leading face of the stack of sheet material may be defined as a face of the stack of sheet material which faces the dispensing opening when the stack of sheet material is placed on the platform and the lid, in which the dispensing opening is provided, is closed.

Exerting a downward force on a leading face of the stack of sheet material may imply that the force is greater than an upward force exerted by the biasing means and the respective force vector points in a direction opposite to a force vector of the force related to the biasing means. The force may be provided by a user by simple pushing the stack of sheet material with one or two hands inside the body of the dispenser.

The leading sheet material may be defined as the sheet material (of the stack of sheet material) being closest to the dispensing opening when the sheet material is placed on the platform and the lid is in the closed use position.

It is to be noted that in the method of the above aspect, the last two steps, i.e. the pivoting step and the extracting step, may be interchanged.

The pair of the locking portions may be arranged at a lower side of the platform.

The lower side of the platform may be the side opposing the side of the platform on which the stack of sheet material is disposed, i.e. the supporting surface of the platform.

With this configuration, since the locking portions are arranged at the lower side of the platform, the locking mechanism does not interfere with the stack of sheet material.

The biasing means may be a spring disposed between a central region of the base and a central region of the platform and the pair of the locking portions of the platform may be located closer to the central region of the platform than to an edge portion of the platform.

The spring may be a coil spring. As such, the spring may have a cylindrical outer shape or a frustoconical outer shape, wherein the diameter of the coil spring may be smaller at the end of the spring facing the base than the diameter of the coil spring at the end of the spring facing the platform, or vice versa.

The spring may be attached both to the base and to the platform. For this purpose, both the base and the platform may be provided with attachment portions, such as hooks or the like.

The central region of the base and the central region of the platform may be understood as central portions of the respective parts, i.e. middle portions of the respective parts not including edge portions thereof. For example, the platform and the base may have a substantially rectangular shape. In this case, the central region of the platform and the base may be understood to be a certain area around the center point of the rectangular base and platform. In particular, in case the spring is a coil spring, the central region may be understood as a portion of the respective part, at which the coil spring is arranged. In this case, the central region may have an extension equal to the shape and the diameter of the coil spring.

Taking the example of the coil spring into account, the feature that the locking portions of the platform may be located closer to the central region of the platform than to an edge portion of the platform may mean that the locking portions of the platform are located closer to the coil spring than to an edge portion of the platform.

With this configuration, a locking connection between the locking ends of the second arms and the locking portions of the platform is established close to the central region of the platform. With this configuration, since the locking connection between the locking ends of the second arms and the locking portions of the platform is not established at an edge portion of the platform, as is the case in state-of-the-art dispensers, the platform can be held in the locking position in a horizontal orientation. Hence, upon releasing the locking mechanism, the stack of sheet material is urged towards the dispensing opening in an upright orientation, thereby enabling easy withdrawal of individual sheet material.

The pair of the engaging portions may protrude from the lower surface of the lid, optionally, each of the pair of the engaging portions may have a length of $1/20$ to $1/5$, preferably $1/15$ to $1/6$, more preferably $1/12$ to $1/8$, most preferably $1/10$ of the length of the first arm.

It may be advantageous when the top ends of the first arms do not protrude from the side wall, for example, in order to prevent unintentional releasing of the locking mechanism when loading the dispenser with sheet material. In this case, providing the engaging portions protruding from the lower surface of the lid in order to engage with the top ends of the first arms upon closing the lid allows the first arms to be designed so as not to protrude from the side wall to which the first arms are attached.

By providing the engaging portions with a length of 1/20 to 1/5, preferably 1/15 to 1/6, more preferably 1/12 to 1/8, most preferably 1/10 of the length of the first arms, the engaging portions can be provided with a short length. This has the advantage that, upon closing the lid, the short engaging portions only come into contact with the top ends of the first arms and thereby release the locking mechanism when the lid is in an almost closed position. Hence, the platform is urged upwards towards the dispensing opening only when the lid is in a closed or an almost closed position. Accordingly, with this configuration, the user is not subjected to any danger by the sudden movement of the platform as it may be the case when the locking mechanism is released with the lid in a half-open position. The narrower the above range, the better the above-mentioned advantages are achieved. If the engaging portion is too short, the locking mechanism may not be reliably released anymore.

The body may have a box shape with two long side walls and two short side walls respectively opposing each other, wherein the lid may be attached to one of the short side walls and the first pair of the first arms may be provided on the other one of the short side walls.

For example, the base of the body may have a rectangular or substantially rectangular shape. In this case, the body may have a cuboid shape.

In case the lid is attached to one of the short side walls and the first arms are provided on the other one of the short side walls, the engaging portions of the lid may be arranged at a portion of the lid opposite to the portion where the lid is attached to the side wall.

With this configuration, since the lid opens and closes across the short side wall, the user can easily handle the stack of sheet material when loading the dispenser and push down the stack of sheet material into the dispenser without interfering with the lid. Moreover, some dispensers are provided with a double-walled side wall in which a space is provided for an advertisement sheet or the like. Preferably, a long side wall is provided with the double-walled side wall in order to provide more space for the advertisement sheet. By attaching the lid to one of the short side walls, the user can easily access the double-walled side wall of the long side wall for placing or removing an advertisement sheet.

Each of the first pair of the first arms may be rotatably attached to the side wall about a respective first axis of rotation and each of the second pair of the second arms may be rotatably attached to the base about a respective second axis of rotation.

For example, the first arms and the second arms may be rotatably attached by means of a pin or the like. In this case, the first and second axes of rotation may pass through the respective pin. In particular, the first axis of rotation and the second axis of rotation may be perpendicular to each other.

With this configuration, the first arms and the second arms perform a rotational instead of a translational movement. Therefore, compared to a translational movement, less space is required for the first arms and the second arms in their extension direction to perform the movement for releasing the locking mechanism.

At least one of the first pair of the first arms and the second pair of the second arms may be rotatably attached with a spring-loaded mechanism, wherein the spring-loaded mechanism may be configured such that the at least one of the first pair of the first arms and the second pair of the second arms rotates about the first or second axis of rotation, respectively, against a biasing force of the spring-loaded mechanism upon bringing the platform in the locking position and/or upon closing the lid.

The spring-loaded mechanism may be provided by means of a leg spring or a torsion spring or the like. Only one of the first pair of the first arms and the second pair of the second arms may be rotatably attached with the spring-loaded mechanism, thereby saving material costs. However, also both of the first pair of the first arms and the second pair of the second arms may be rotatably attached with the spring-loaded mechanism.

For example, in case the second arms are provided with a spring-loaded mechanism and in case the locking portions of the platform have a snap hook design, when the platform is pushed towards the base of the body, the snap hook of the locking portions coming into contact with the locking ends of the second arms may cause the second arms to perform a rotational movement about the second axis of rotation against the biasing force of the spring-loaded mechanism of the second arms. Upon completion of the downward movement of the platform, i.e. when the platform is in the lowermost position, the second arms may perform a rotational movement in the opposite direction, urged by the spring-loaded mechanism in the second arms, thereby completing the snap hook locking. For releasing the snap hook locking, the lid is closed, whereby the engaging portions may engage with the top ends of the first arms, whereby the first arms may perform a rotational movement which is transferred to the second arms via cooperation of the base ends of the first arms with the side wall ends of the second arms. At this time, the second arms undergo a rotational movement against the biasing force of the spring-loaded mechanism, thereby disengaging from the snap hook of the locking portions of the platform. With this, the platform is released and urged in an upward direction towards the dispensing opening by the biasing means.

Since the base ends of the first arms and the side wall ends of the second arms are configured to cooperate with each other, only one spring-loaded mechanism, either in the first arm or in the second arm, may be necessary, thereby saving components and costs.

With this configuration, it is possible to provide an easy design of the releasable locking mechanism, wherein the components of the locking mechanism always return to their original position by means of the biasing force of the spring-loaded mechanism, thereby enabling repeated locking and releasing of the locking mechanism.

Each of the pair of the engaging portions may have a slanted surface matching with a corresponding slanted surface provided on the top end of the respective first arm.

For example, the slanted surface may be angled with respect to the base of the body, having an angle of about 45°. In particular, the surface normal of the slanted surface of the engaging portions may point in an opposite direction as the surface normal of the corresponding slanted surface provided on the top ends of the first arms.

With this configuration, when the lid is closed and the engaging portions engage with the top ends of the first arms, due to the provision of slanted surfaces, the engaging portions make the first arms performing a rotational movement. Hence, it is possible to provide an easy means for urging the first arms and, consequently, the second arms in a rotational movement. Instead of providing slanted surfaces, it may also be conceivable that the engaging portions are movably attached to the lid and thereby make the first arms performing a rotational movement. This, however, requires the provision of a more complicated attachment of the engaging portions.

The dispenser may have a spring-loaded latch for releasably locking the lid to the body.

The spring-loaded mechanism for the spring-loaded latch may be constituted by a leg spring or a torsion spring or the like. The spring-loaded latch may be provided on the lid or on one of the side walls of the body.

With this configuration, it is possible to provide an easy mechanism of keeping the dispenser in a closed state.

The locking portions of the platform may be symmetrically arranged with respect to a longitudinal axis or a transversal axis of the platform, wherein the first pair of the first arms may be symmetrically arranged with respect to a central axis of the one of the side walls, the central axis of the one of the side walls extending in a direction from the top to the base and dividing the one of the side walls into two halves, wherein the second pair of the second arms may be symmetrically arranged with respect to a central axis of the base, the central axis of the base extending in a direction from the side wall at which the first pair of the first arms is arranged towards the opposite side wall and dividing the base into two halves.

For example, in case the body has a box shape or a cuboid shape, the central axis of the one of the side walls and the central axis of the base may correspond to the perpendicular bisector of the one of the side walls and, respectively, of the base.

It is to be understood, that this configuration not only means that the central axis divides the one of the side walls or the base into two perfectly equal haves, but may also mean that the central axis does not divide the respective parts into two perfectly equal haves, but into nearly equal halves.

In case of a rectangular shape of the platform, the longitudinal axis may be the long axis of the platform and the transversal axis may be the short axis of the platform. In case of a square shape of the platform, one of the perpendicular bisectors of the square-shaped platform may be the longitudinal axis and the other one of the perpendicular bisectors of the square-shaped platform may be the transversal axis. Both the longitudinal axis and the transversal axis may divide the platform into two halves, as is the case for the central axis.

"Symmetrically arranged" with respect to the respective axis may mean that the respective parts have the same distance to the axis. It does, however, not necessarily imply that the respective parts need to be mirror symmetric.

In particular, however, the locking portions of the platform may be mirror symmetric with respect to longitudinal axis or the transversal axis of the platform, the first pair of the first arms may be mirror symmetric with respect to the central axis of the one of the side walls, and the second pair of the second arms may be mirror symmetric with respect to the central axis of the base.

For example, in case the body has a box shape with two long side walls and two short side walls respectively opposing each other, the first pair of the first arms may be arranged at one of the short side walls or may be arranged at one of long side walls.

With this configuration, it is possible to provide the locking mechanism with the smallest possible length of the first arms and the second arms, thereby saving material costs. Moreover, with this configuration, due to the fact that the components constituting the locking mechanism are arranged symmetrically with respect to the respective axes, the platform of the dispenser can be particularly reliably held in the locking position in a horizontal orientation, thereby enabling a particularly reliable urging of the platform and the stack of sheet material towards the dispensing opening in an upright orientation and, thus, easy withdrawal of individual sheet material.

Having such an arrangement is not obviously derivable by the person skilled in the art, as arranging the respective components constituting the locking mechanism symmetrically with respect to the respective axes, at first sight, provokes a more precise alignment and construction of the involved components.

According to another aspect, there is provided a method for loading a stack of sheet material into a dispenser for dispensing said sheet material, the method including:

moving a lid of the dispenser from a closed use position into an open refilling position; the dispenser including: a body having four side walls configured to accommodate a stack of the sheet material, a base, e.g. for resting on a support surface, an opening in a top of the body, and a lid for covering the opening in use and enabling access to the opening for refilling, wherein the lid may be detachable for giving access to the opening, or, alternatively, wherein the lid may be movably attached to at least one of the side walls and may be sized to cover the opening, the lid having a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a biasing means for urging the platform towards the lid, wherein at least one of the side walls is a double-walled side wall including an inner wall and an outer wall, a space being defined between the inner wall and the outer wall, and wherein at least part of the inner wall is pivotable around a pivot axis to the inside of the body, wherein the inner wall is fixed to the outer wall via releasable latches;

placing the stack of sheet material via the opening with a trailing face of the stack of sheet material on a supporting surface of the platform;

exerting a force on a leading face of the stack of sheet material opposite to the trailing face to thereby push the platform into the body;

pivoting the lid from the open refilling position into the closed use position; and extracting a portion of a leading sheet material from the leading face of the stack of sheet material through the dispensing opening of the lid, to thereby dispense the leading sheet material.

It is to be noted that in the method of the above another aspect, the last two steps, i.e. the pivoting step and the extracting step, may be interchanged.

In the following, features of the another aspect denoted with the same terms as the features described above in context with the one aspect can have the same characteristics as the respective features of the one aspect. Likewise, the features described above in context with the one aspect and denoted with the same terms as the features of the another aspect can have the same characteristics as the respective features of the another aspect.

In this context, the body, the base, and the lid may be understood as external, usually hard (rigid) protective and/or enclosing case or cover of the dispenser. In the same manner the base may be understood as the bottom and/or supporting part of such an outer shell of the dispenser achieved by the four side walls.

The dispensing opening in the outer shell, i.e., in the lid, is to be understood as the opening through which a sheet material may be withdrawn from the dispenser by a user. The base may have a support surface, or a pedestal configured to place the base, and thus enables the dispenser to be securely placed on a horizontal surface such as a table or counter. In such an arrangement, the dispensing opening in the lid may open to the top of the dispenser and the dispenser rests on the support surface via the base thereof. Accordingly, the sheet material may be dispensed along a vertical direction when the dispenser rests on a support surface via the base.

Yet, it may also be possible to arrange the described tabletop dispenser in an upright/flipped position, that is, in a position, in which the base extends in a vertical direction and the dispenser rests on one of the four side walls. Accordingly, also the lid, which opposes the base of the dispenser, may extend along the vertical direction, such that sheet material may be dispensed along a horizontal direction via the lid.

Thus, the base and/or at least one of the side walls may include an anti-slip protection to ensure a fixed position of the dispenser when resting on the base or on one of the side walls.

At least one of the side walls is a double-walled side wall including an inner wall and an outer wall. Thereby, a space is defined between the inner wall and the outer wall.

Furthermore, at least part of the inner wall is pivotable around a pivot axis and open inwards, toward the inside of the body.

According to such an arrangement, it is possible to achieve a dispenser having a closed outer shell, such that no dust, dirt or any other pollutant can enter the dispenser through one of the side walls, in particular one of the outer walls of the side walls, and an improved appearance can be achieved and maintained over a long period of use. Moreover, a more hygienic environment can be achieved.

Additionally, a placard displaying commercials, advertisements, menus, or the like can be easily inserted into to the space or removed therefrom. Accordingly, the usability of the dispenser can be improved.

Since such a dispenser is not open to the outside, inadvertent or unauthorized removal of the placard can also be avoided.

Further, having an inner wall that opens inwardly instead of having a dispenser in which at least part of a side wall opens outwardly, facilitates cleaning of that inner wall.

Accordingly, the key idea of such a dispenser is to facilitate the usability, to improve the cleanability and to optimize the appearance for a long period of use.

In this context, the feature that "at least part of the inner wall is pivotable around a pivot axis to the inside of the body" may be understood in such a manner that the inner wall is hinged to the body, such that the inner wall can be tilted away from the outer wall via hinges provided on the body. Accordingly, the inner wall in such a dispenser may be understood as a "pivotable inner wall".

The outer wall forming part of the outer shell of the dispenser can, consequently, remain fixed in position and does not require any recesses, opening mechanisms, or the like.

Further, it should be highlighted that when a user wishes to change or insert a placard containing an advertisement, a menu, or the like into such a dispenser, the above-mentioned lid is likely open, such that the inside of the body can be accessed.

Furthermore, the inner wall is fixed to the outer wall via releasable latches.

Accordingly, the position of the inner wall relative to the outer wall can be fixed when there is no need to exchange or insert a placard containing an advertisement, menu, or the like into the dispenser. The at least one latch prevents accidental tilting of the inner wall toward the inside of the dispenser. Accordingly, an accidental interaction/interference of the pivotable inner wall together with, e.g., a stack of dispensing sheet material that may be arranged inside the dispenser can be avoided. Thus, a smooth and trouble-free use of the dispenser can be ensured, which additionally allows to display an advertisement, menu, or the like in a clean manner.

The pivot axis may extend perpendicular to the base. In another embodiment, however, the pivot axis may extend along a dimension that is parallel to the base.

Put differently, the pivot axis may extend, for example, in a horizontal direction, when the dispenser is based on a support surface, e.g. a tabletop surface. Accordingly, the inner wall may be pivotable around the horizontal axis and may thereby hinge the inner wall along such a pivot axis. Accordingly, the inner wall can be tilted away from the outer wall to the inside of the dispenser and also the surface of the outer wall facing the inside of the dispenser can be easily accessed and, e.g., cleaned easily.

Having such an arrangement is not obviously derivable by the person skilled in the art, as a pivotally movable inner wall, at first sight, provokes a more complex system and requires that a platform on which the sheet material is to be placed may be pushed downwards before the space between the inner wall and the outer wall can be accessed.

The pivot axis may be arranged at a lower end of the double-walled side wall adjacent the base.

Accordingly, having a pivot axis arranged at the lower end of the inner wall allows to tilt the whole inner wall away from the outer wall and to thereby more easily insert new or different placards containing advertisements, menus, or the like.

In an alternative embodiment the pivot axis may be arranged between the lower end and the upper end of the double-walled side wall.

That is, the inner wall and the outer wall may run in parallel along a vertical direction for a certain percentage of the height of the side wall, and may include a pivot axis that is arranged between the lower end and the upper end of the double-walled side wall. For example, the pivot axis may be arranged in the middle between the lower end and the upper end of the height of the double-walled side wall. That is, only half of the inner wall may be pivotable to the inside of the dispenser body, whereas the other half may remain in parallel to the outer wall.

Accordingly, the pivot axis can be arranged at a higher position than the previously described embodiment including a pivot axis that is arranged at a lower end of the double-walled side wall adjacent the base, and may thereby facilitate the manufacturing, in particular because the pivot axis and the corresponding hinges are not arranged at one of the corner parts. The term "corner parts" may be understood as a contact region of the base for resting on the support surface and at least one of the side walls of the body. That is, one of the edges of the box-like shape of the dispenser The outer wall may be at least partially transparent.

Accordingly, the outer wall enables the display of advertisements, menus, or the like to the outside and, therefore, permits the dispenser to be used as way of displaying an advertisement inside restaurants, in particular fast-food restaurants, or the like.

In another embodiment, the outer wall may be completely transparent.

Accordingly, the full size of the side wall can be used for displaying advertisements, menus, or any other information on the dispenser.

In another embodiment, at least two of the side walls may be double-walled side walls and both inner walls of the respective side walls may be inwardly pivotable around respective pivot axes toward the inside of the body.

Put differently, both of said double-walled side walls include tiltable inner walls, that can be hinged towards the inside of the body.

Accordingly, at least two of the side walls can be used for displaying advertisements, menus, or any other information on the dispenser.

Two opposing side walls may be double-walled side walls.

Due to such a configuration, it is possible, that, when an advertisement, menu, or the like is arranged inside the space, i.e., inside the space between the inner wall and the outer wall, and such a dispenser is placed on a table, e.g., in a restaurant, guests, sitting on opposite sides of the table, can easily and readily take notice of the advertisement, menu, or the like. Also mixed configurations of having a menu arranged in one of said side walls and having an advertisement in the other one of said side walls is possible.

The body may have a rectangular shape when seen in a plan view with two long side walls and two short side walls respectively opposing each other, wherein the at least one double-walled side wall may be arranged on one of the long side walls.

Such an arrangement permits the placard containing an advertisement, menu or the like to be displayed on the larger surface of the side walls of the dispenser body having a box-like shape when seen in a plan view.

The inner wall may include at least one recess arranged at the upper end thereof.

Accordingly, it is possible to more easily grasp a placard containing an advertisement, menu, or the like, that is arranged inside the space between the inner wall and the outer wall.

Further, the tilting of the inner wall can be more easily performed as it is easy for a user to grasp the inner wall and to move it to the inside of the dispenser via a tilting around the pivot axis.

Further, the lid may be movably attached to at least one of the side walls of the body via a hinge.

Accordingly, the lid may be permanently attached to the body of the dispenser and may be tilted from an open refilling position to a closed use position. Such an arrangement ensures an easy and reliable closing and opening of the lid with respect to the body of the dispenser.

Alternatively, the lid may be configured to be reversibly removable and attachable to the body. In other words, the lid may be temporarily removable from the body of the dispenser and be re-attached thereto. This may allow for easier refilling of the dispenser, as the lid can temporarily be put aside.

The dispenser may further include a releasable locking mechanism as described above with respect to the one aspect for holding the platform in a locking position at the lowermost position.

According to such a configuration it is possible to hold the platform downwards when inserting the stack of sheet material into the dispenser and to release it once the inserting is completed. Further, in the present context, it is possible to maintain the platform that is urged towards the lid in a lowermost position when inserting or exchanging the placard containing an advertisement, menu, or the like in the dispenser.

That is, one could first lock the platform in a lowermost position, and then easily access the space between the outer wall and the inner wall by pivoting the inner wall toward the inside of the dispenser. Subsequently, one can introduce or exchange the placard containing an advertisement, menu, or the like arranged between the outer wall and the inner wall, and finally release the platform in order to allow the biasing means to push the platform with a stack of sheet material arranged thereon towards the lid.

The method may further include the steps of:

pivoting the inner wall around the pivot axis to the inside of the body;

inserting a sheet into the space being defined between the inner wall and the outer wall; and pivoting the inner wall around the pivot axis to the outer wall of the body.

These steps may be performed before the steps relating to loading a stack of sheet material into the dispenser, so that neither the platform nor the stack of sheet material obstruct the pivoting movement of the inner wall around the pivot axis to the inside of the body.

With this configuration it is possible to easily insert the placard or sheet, for example an advertisement sheet, a menu sheet, or the like, in the space of the double-walled side wall.

The following itemized aspects also form part of the present disclosure.

1. A dispenser for dispensing sheet material, including:
   a body (1) having four side walls (2, 3, 4, 5),
   a base (6),
   an opening (7) in a top of the body (1),
   a lid (8) for covering the opening (7) in use and enabling access to the opening (7) for refilling, wherein the lid (8) has a dispensing opening (9) therein to enable sheet material to be dispensed therefrom,
   a platform (10) for supporting a plurality of sheet material from below, wherein the platform (10) is movable from a lowermost position when the dispenser is filled with sheet material to an uppermost position adjacent the lid (8) when the dispenser is more nearly empty of sheet material,
   a biasing means (11) for urging the platform (10) towards the lid (8),
   a releasable locking mechanism for holding the platform (10) in a locking position in the lowermost position, the releasable locking mechanism including:
   a first pair of first arms (12) movably attached to one of the side walls (2, 3, 4, 5) and extending in a direction from the top towards the base (6) of the body (1), wherein each of the first pair of the first arms (12) has a top end (13) and a base end (14),
   a second pair of second arms (15) movably attached to the base (6) and extending in a direction from the side wall to which the first pair of the first arms (12)

is attached towards a center of the base (6), wherein each of the second pair of the second arms (15) has a side wall end (16) and a locking end (17), the side wall end (16) being configured to cooperate with the respective base end (14) of the respective first arm (12) such that a movement of the first arm (12) causes a movement of the second arm (15), the locking end (17) being configured to releasably interlock with a respective locking portion (18) of a pair of locking portions (18) arranged at the platform (10) to thereby hold the platform (10) in the locking position, wherein the lid (8) has a pair of engaging portions (19) at its lower surface, wherein each of the pair of the engaging portions (19) is configured to engage with the respective top end (13) of the respective first arm (12) upon closing the lid (8) to thereby release the platform (10) from the locking position.

2. The dispenser according to item 1,
wherein the pair of the locking portions (18) is arranged at a lower side of the platform (10).

3. The dispenser according to item 1 or 2,
wherein the biasing means (11) is a spring attached between a central region of the base (6) and a central region of the platform (10) and wherein the pair of the locking portions (18) of the platform (10) is located closer to the central region of the platform (10) than to an edge portion of the platform (10).

4. The dispenser according to any one of the preceding items,
wherein the pair of the engaging portions (19) protrudes from the lower surface of the lid (8), optionally, wherein each of the pair of the engaging portions (19) has a length of 1/20 to 1/5, preferably 1/15 to 1/6, more preferably 1/12 to 1/8, most preferably 1/10 of the length of the first arm (12).

5. The dispenser according to any one of the preceding items,
wherein the body (1) has a box shape with two long side walls (3, 5) and two short side walls (2, 4) respectively opposing each other, wherein the lid (8) is attached to one of the short side walls (2, 4) and the first pair of the first arms (12) is provided on the other one of the short side walls (2, 4).

6. The dispenser according to any one of the preceding items,
wherein each of the first pair of the first arms (12) is rotatably attached to the side wall about a respective first axis of rotation (A) and each of the second pair of the second arms (15) is rotatably attached to the base (6) about a respective second axis of rotation (B).

7. The dispenser according to item 6,
wherein at least one of the first pair of the first arms (12) and the second pair of the second arms (15) is rotatably attached with a spring-loaded mechanism, wherein the spring-loaded mechanism is configured such that the at least one of the first pair of the first arms (12) and the second pair of the second arms (15) rotates about the first or second axis of rotation (A, B), respectively, against a biasing force of the spring-loaded mechanism upon bringing the platform (10) in the locking position and/or upon closing the lid (8).

8. The dispenser according to item 6 or 7,
wherein each of the pair of the engaging portions (19) has a slanted surface (20) matching with a corresponding slanted surface provided on the top end (13) of the respective first arm (12).

9. The dispenser according to any one of the preceding items,
wherein the dispenser has a spring-loaded latch (21) for releasably locking the lid (8) to the body (1).

10. The dispenser according to any one of the preceding items,
wherein the locking portions (18) of the platform (10) are symmetrically arranged with respect to a longitudinal axis or a transversal axis of the platform (10),
wherein the first pair of the first arms (12) is symmetrically arranged with respect to a central axis (C) of the one of the side walls (2, 3, 4, 5), the central axis (C) of the one of the side walls (2, 3, 4, 5) extending in a direction from the top to the base (6) and dividing the one of the side walls (2, 3, 4, 5) into two halves,
wherein the second pair of the second arms (15) is symmetrically arranged with respect to a central axis (D) of the base (6), the central axis (D) of the base (6) extending in a direction from the side wall at which the first pair of the first arms (12) is arranged towards the opposite side wall and dividing the base (6) into two halves.

11. The dispenser according to any one of the preceding items for dispensing sheet material (26),
wherein at least one of the side walls (2, 3, 4, 5) is a double-walled side wall including an inner wall (27) and an outer wall (28), a space (29) being defined between the inner wall (27) and the outer wall (28), and
wherein at least part of the inner wall (27) is pivotable around a pivot axis (30) to the inside of the body (1),
wherein the inner wall (27) is fixed to the outer wall (28) via releasable latches (31).

12. The dispenser according to item 11, wherein the pivot axis (30) extends in parallel to the base (6).

13. The dispenser according to item 11 or 12, wherein the pivot axis (30) is arranged at a lower end of the double walled side wall (3) adjacent the base (6).

14. The dispenser according to any one of items 11 to 13, wherein the outer wall (28) is at least partially transparent.

15. The dispenser according to any one of items 11 to 14, wherein at least two of the side walls (3, 5) are double-walled side walls, and wherein both inner walls (27) of the respective side walls (3, 5) are pivotable around respective pivot axes (30) to the inside of the body (1).

16. The dispenser according to item 15, wherein two opposing side walls (3, 5) are double-walled side walls.

17. The dispenser according to any one of items 11 to 16, wherein the body (1) has a rectangular shape when seen in a plan view with two long side walls (3, 5) and two short side walls (2, 4) respectively opposing each other, wherein the at least one double-walled side wall is arranged on one of the long side walls (3, 5).

18. The dispenser according to any one of items 11 to 17, wherein the inner wall (27) includes at least one recess (32) arranged at the upper end thereof.

19. The dispenser according to any one of the preceding items, wherein the lid (8) is moveably attached to at least one of the side walls (2, 3, 4, 5) of the body (1) via a hinge.

20. The dispenser according to any one of items 1 to 18, wherein the lid (8) is configured to be reversibly removable and attachable to the body (1).

21. A system including a dispenser according to any one of the preceding items and sheet material (26), optionally, a stack of sheet material (26), for being loaded in the dispenser.

In particular, with the above dispenser and the above system, the same advantages as discussed herein with respect to the method of the one aspect and the method of the another aspect can be achieved.

The dispenser as discussed herein may, as an example, have the following dimensions: the dispenser may have a height of 170 mm and a width of 200 mm and a depth of 141 mm. The height may include feet on which the dispenser may rest. It is to be understood that the dispenser may also have slightly smaller or larger dimensions than the above dimensions due to measurement tolerances.

The sheet material as discussed herein may be napkins. An individual sheet material may be an individual napkin. The individual napkin may, as an example, have the following nominal dimensions: when being folded in a stack of sheet material (stack of napkins), the individual napkin may have, in the folded state, a width of 165 mm and a length of 108 mm, or, alternatively, a width of 161 mm and a length of 105 mm. When being unfolded, in case of ½ fold, the individual napkin may have a width of 165 mm and a length of 216 mm, or, alternatively, a width of 161 mm and a length of 210 mm. Further, in case of ¼ fold, the individual napkin may have a width of 330 mm and a length of 216 mm. The above width dimensions of the individual napkin may vary between 3 to 5 mm. The above length dimensions of the individual napkin may have a smaller variation than the variation of the width dimension.

Further aspects of the present disclosure may be found in the following description of a particular embodiment referring to the accompanying drawings.

DETAILED DESCRIPTION OF A PARTICULAR EMBODIMENT

Figure 1:
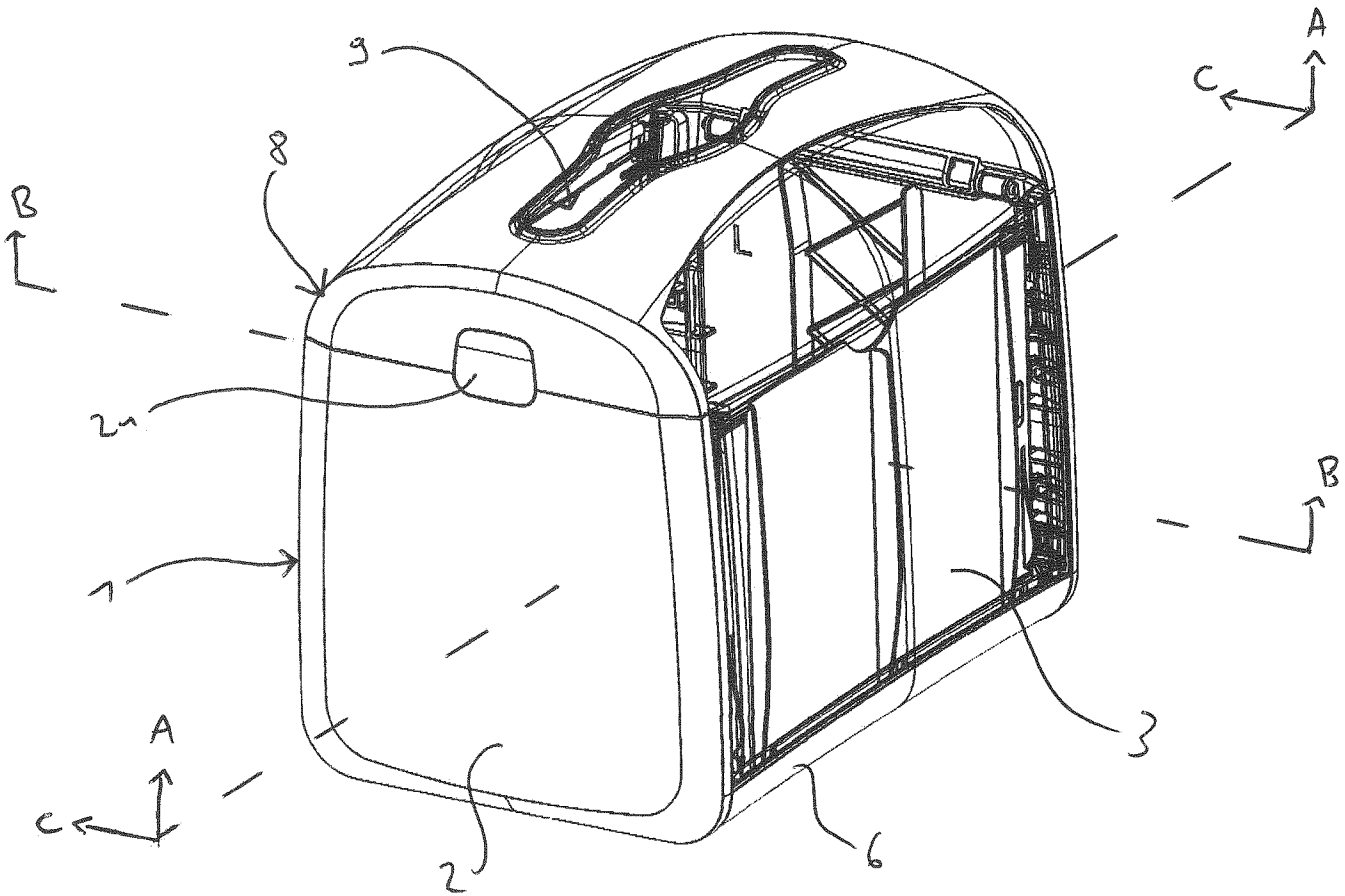
FIG. 1 is a perspective view of a tabletop dispenser.

Hereinafter, an embodiment according to the disclosure will be described in detail with reference to the accompanying drawings in order to describe the disclosure using illustrative examples. Further modifications of certain individual features described in this context can be combined with other features of the described embodiments to form further embodiments of the disclosure.

Throughout the drawings, the same reference numerals are used for similar elements.

FIG. 1 is a perspective view of a tabletop dispenser. The tabletop dispenser of the exemplary embodiment includes a body 1 having four side walls 2, 3, 4, and 5 (the side wall 4 is the side wall opposite to the side wall 2, and the sidewall 5 is a side wall opposite to the side wall 3). The tabletop dispenser further has a base 6 and a lid 8. The tabletop dispenser of this embodiment has a box shape with the two short side walls 2, 3 and the two long side walls 3, 5. In this embodiment, the lid 8 is movably attached to the short side wall 4. The lid 8 is provided with a dispensing opening 9 having a slot shape, wherein the two sections to the side are slot shaped and the central portion of the opening has an oval shape. Moreover, the tabletop dispenser includes a spring-loaded latch 21.

Figure 2:
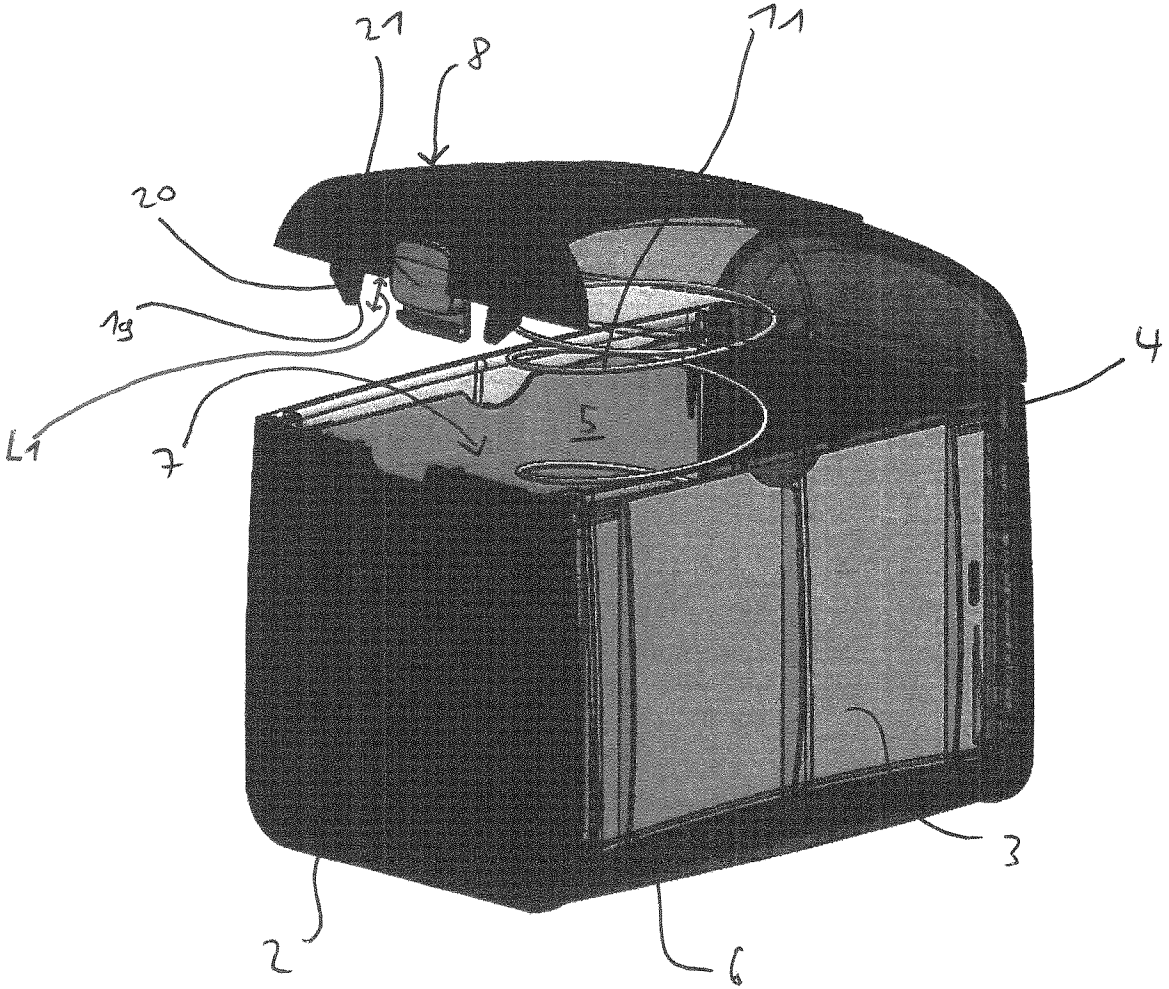
FIG. 2 is a perspective view of the tabletop dispenser of FIG. 1 with an open lid, wherein a platform is omitted.

FIG. 2 is a perspective view of the tabletop dispenser of FIG. 1 with an open lid 8, wherein a platform 10 is omitted. The lid 8 is movably attached to the short side wall 4 by means of hinges, such that the lid 8 can be opened across the short side wall 4. When the lid 8 is completely opened, the opening 7 in a top of the body is easily accessible. In this embodiment, a coil spring is provided as a biasing means 11. The coil spring shown in FIG. 2 is in a relaxed state. Furthermore, the lid 8 has a pair of engaging portions 19 provided at its lower surface. Each of the engaging portions 19 has a slanted surface 20.

Figure 3:
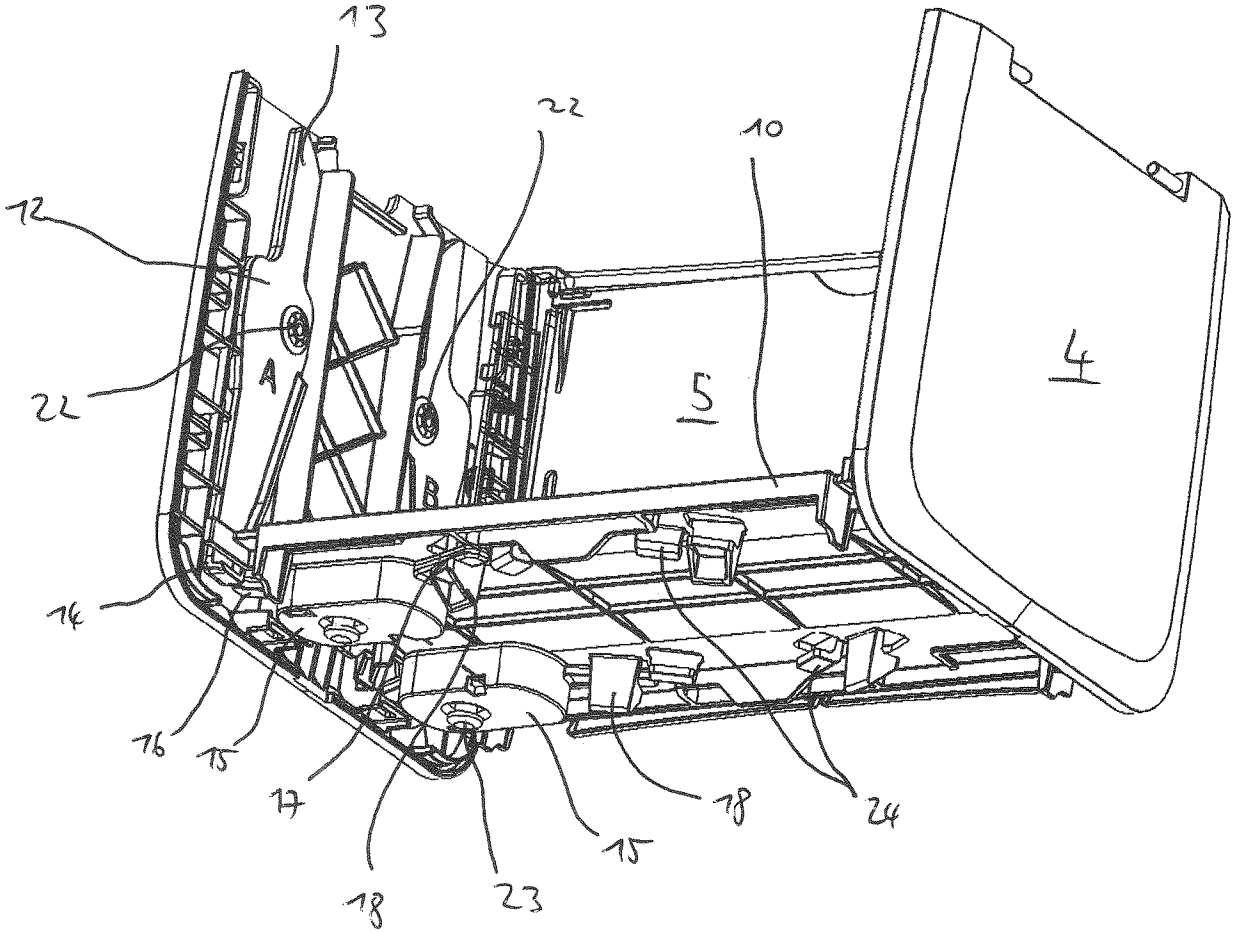
FIG. 3 is a perspective view of the tabletop dispenser of FIG. 1 wherein a base, a side wall, a biasing means, and a lid are omitted.

FIG. 3 is a perspective view of the tabletop dispenser of FIG. 1 wherein the base 6, the side wall 3, the lid 8, and the biasing means 11 are omitted. A first pair of first arms 12 is attached to the side wall 2 (the side wall 2 is opposite to the side wall 4). In this embodiment, the first pair of the first arms 12 is rotatably attached to the side wall 2 by means of a pair of pins 22. Moreover, as can be seen, the first arms 12 are mirror symmetric with respect to a central axis C of the side wall 2, wherein the central axis C extends in a direction from the base 6 of the body 1 towards the top of the body 1 and divides the side wall 2 into two halves (shown in more detail in FIG. 5). Likewise, the second pair of the second arms 15 is attached to the base 6 (the base 6 is not shown in FIG. 3). The second pair of second arms 15 is rotatably attached to the base 6 by means of pins 23. Moreover, as can be seen, the second arms 15 are mirror symmetric with respect to a central axis D of the base 6, wherein the central axis D extends in a direction from the side wall 2 towards the side wall 4 and divides the base 6 into two halves (shown in more detail in FIG. 6). In this embodiment, the second arms 15 are also mirror symmetric with respect to a longitudinal axis of the platform 10.

Each of the first arms 12 has a top end 13 and a base end 14. The top end 13 is provided with a slanted surface matching with the slanted surface 20 of the engaging portion 19. The base end 14 is configured to cooperate with the side wall end 16 of the second arm 15. Each of the second arms 15 has the side wall end 16 configured to cooperate with the base and 14 of the first arm 12 and has a locking end 17 configured to releasably interlock with a locking portion 18 arranged at the platform 10, thereby holding the platform 10 in the locking position, as seen in FIG. 3. In this embodiment, the locking portion 18 has a snap hook design. Further, in this embodiment, each of the second pair of the second arms 15 includes a spring-loaded mechanism.

Moreover, as can be seen in FIG. 3, hooks 24 are provided on the lower side of the platform 10 for attachment of the biasing means 11 which, in the present embodiment, is a coil spring, as described above. In this case, the central region of the platform 10 corresponds to the region where the upper end of the coil spring is attached to the platform 10. Since the locking portions 18 are located closer to the central region of the platform 10 than to an edge portion of the platform 10 and are symmetrically arranged with respect to the longitudinal axis of the platform 10, the platform 10 can be held in the locking position in a horizontal orientation, thereby achieving the above-described advantages. Specifically, upon releasing the locking mechanism, the platform 10 and the stack of sheet material placed thereon is urged towards the dispensing opening 9 in an upright orientation which enables easy grasping of individual sheet material.

Figure 4:
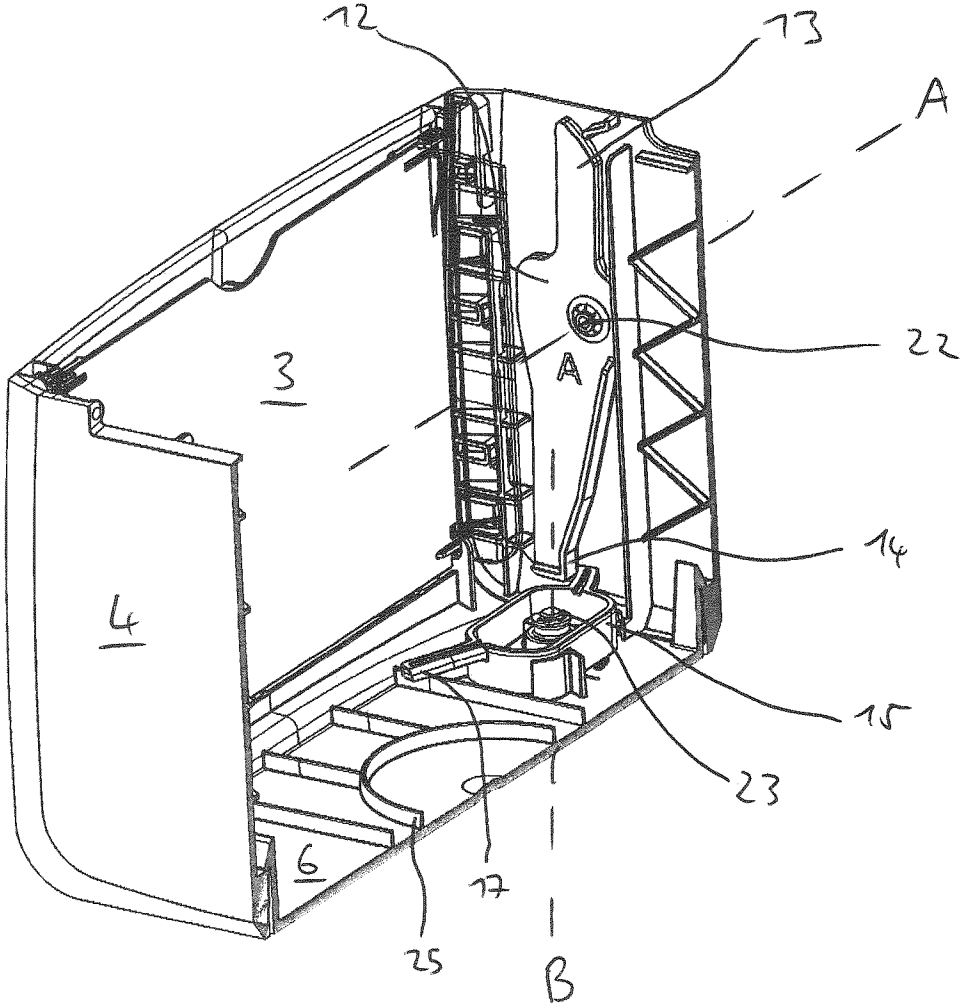
FIG. 4 is a perspective sectional view along the line A-A in FIG. 1, wherein a lid, a platform, and a biasing means are omitted.

FIGS. 3 and 4 also illustrate the releasable locking mechanism according to the present disclosure. In FIG. 3, the platform 10 is in the locking position in the lowermost position. In order to release the locking mechanism, the lid 8 is brought into the closed position, whereby the slanted surface 20 of the engaging portion 19 is brought into contact with the slanted surface provided at the top end 13 of the first arm 12. As a result, each of the first arms 12 rotates about a first axis of rotation A (shown in FIG. 4) passing through the pins 22. In this embodiment, specifically, as seen in a direction towards the first arms 12, the left first arm 12 rotates counterclockwise, whereas the right first arm 12 rotates clockwise. At the same time, since the base end 14 of the first arm 12 is configured to cooperate with the side wall end 16 of the second arm 15, each of the second arms 15 is also subjected to a rotational movement about a second axis of rotation B (shown in FIG. 4) passing through the pins 23. In this embodiment, specifically, as seen from below, the left second arm 15 cooperating with the left first arm 12 rotates counterclockwise, whereas the right second arm 15 cooperating with the right first arm 12 rotates clockwise. With this movement, the locking end 17 of each of the second arms 15 disengages from each of the locking portions 18, thereby releasing the locking mechanism.

FIG. 4 is a perspective sectional view along the line A-A in FIG. 1, wherein the lid 8, the platform 10, and the biasing means 11 are omitted. As can be seen in FIG. 4, the first arm 12 is rotatably attached at the sidewall 2 about the first axis of rotation A. The second arm 15 is rotatably attached at the base 6 about the second axis of rotation B. In this embodiment, the first axis of rotation A is perpendicular to the second axis of rotation B. Moreover, the base 6 has a circular wall portion 25 which is provided for holding the biasing means 11 in form of a coil spring in place. Thus, considering the above explanations with respect to the central region, this portion of the base 6 may be considered as central region of the base 6.

Figure 5:
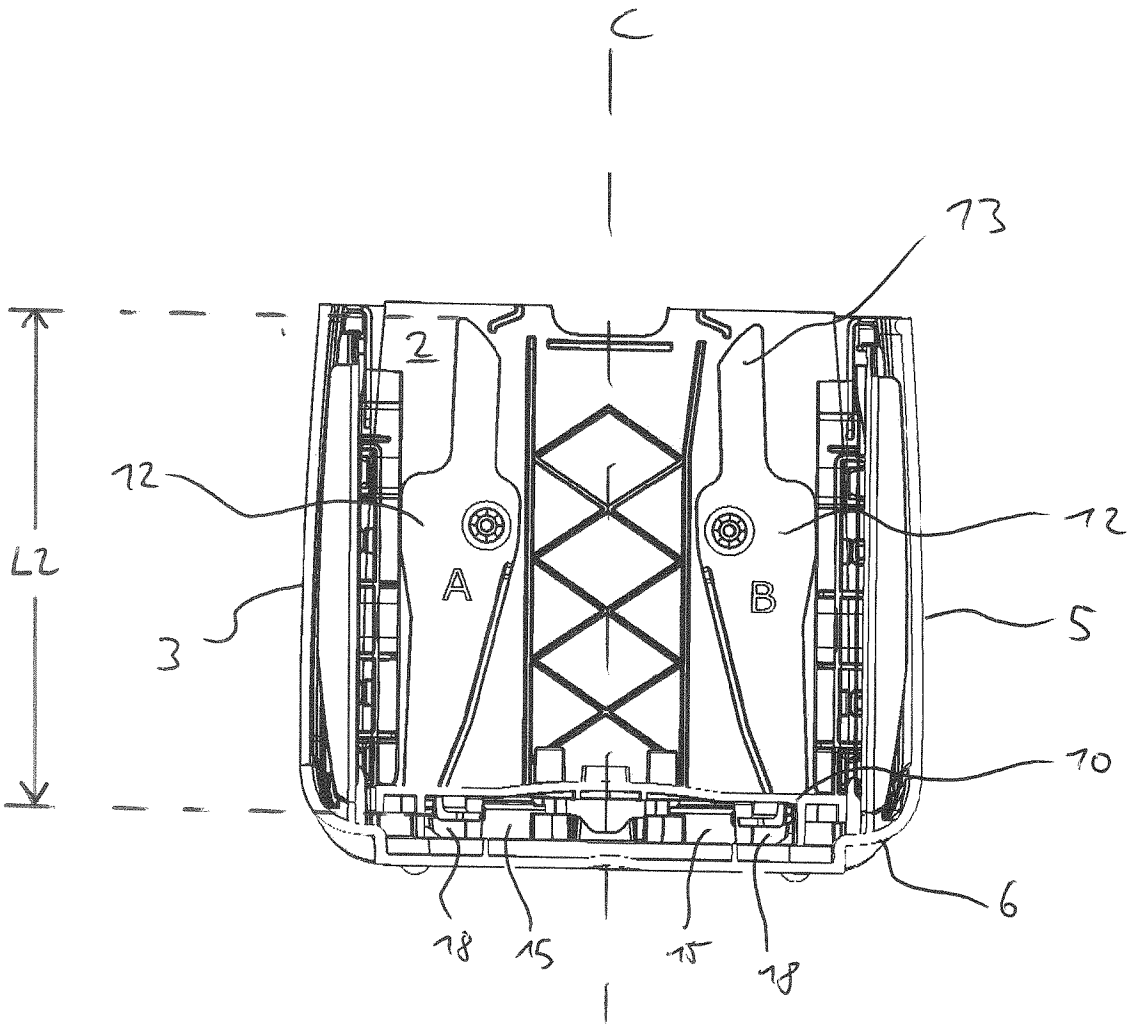
FIG. 5 is a sectional view along the line B-B in FIG. 1, wherein a lid and a biasing means are omitted.

FIG. 5 is a sectional view along the line B-B in FIG. 1, wherein the lid 8 and the biasing means 11 are omitted. As can be seen in FIG. 5, the locking portion 18 is arranged at a lower side of the platform 10. Furthermore, each of the second pair of the second arms 15 is disposed below the platform 10, thereby not interfering with the stack of sheet material.

Figure 6:
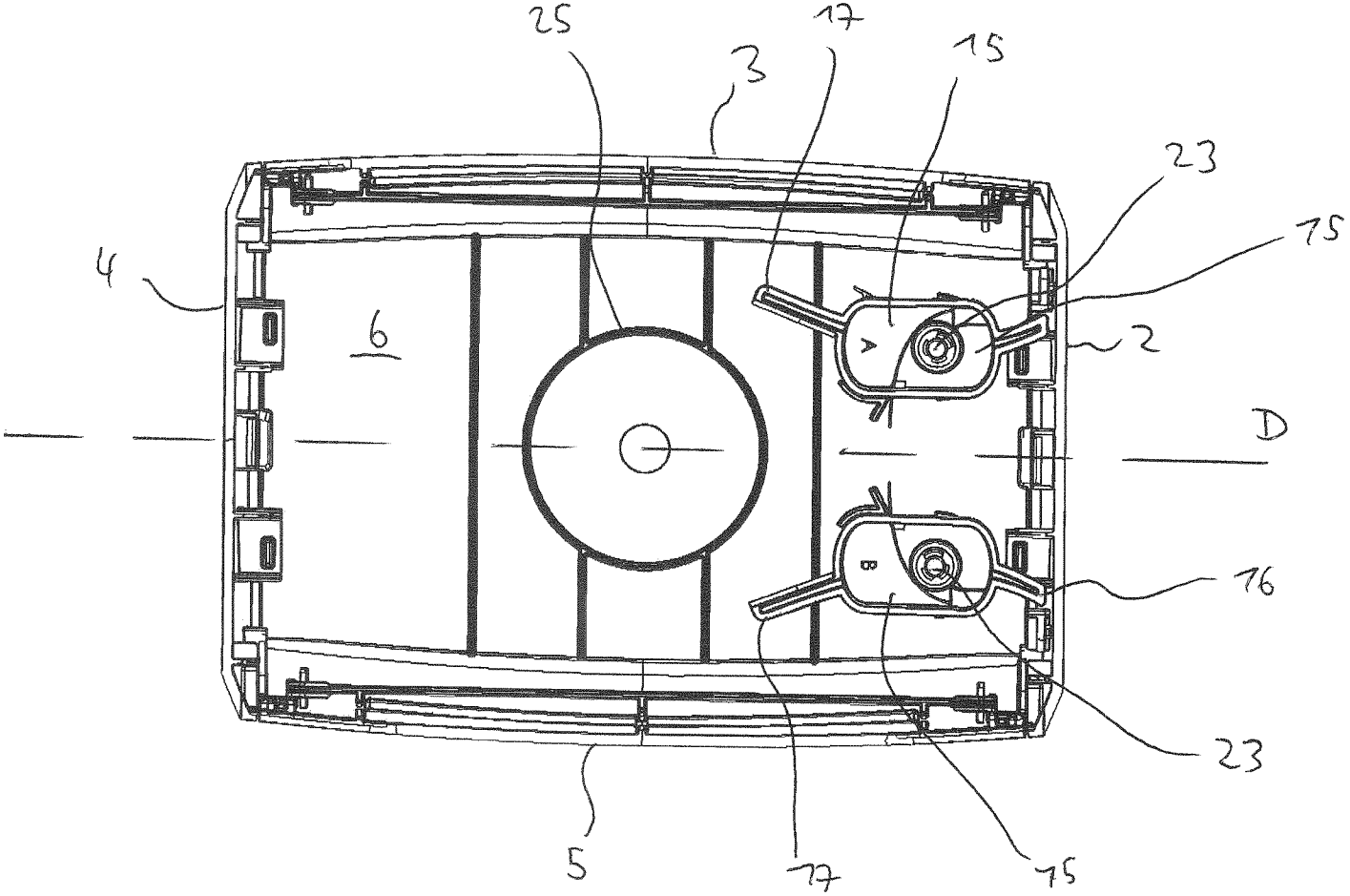
FIG. 6 is a sectional view along the line C-C in FIG. 1, wherein a platform and a biasing means are omitted.

FIG. 6 is a sectional view along the line C-C in FIG. 1, wherein the platform 10 and the biasing means 11 are omitted. FIG. 6 illustrates the mirror symmetric configuration of the second pair of the second arms 15 with respect to the central axis D of the base 6. Due to the second arms 15 being arranged symmetrically with respect to the central axis D, the platform 10 of the dispenser can be particularly reliably held in the locking position in a horizontal orientation, thereby enabling a more reliable urging of the platform 10 and the stack of sheet material towards the dispensing opening 9 in an upright orientation and, thus, easy withdrawal of individual sheet material.

Figure 7:
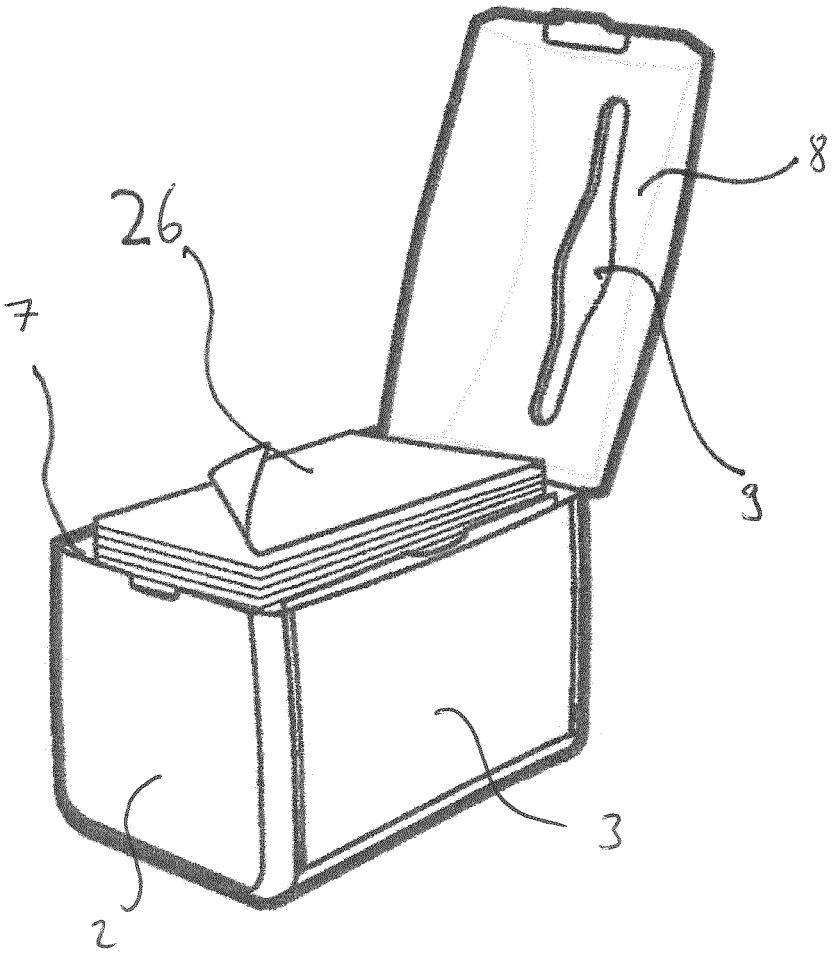
FIG. 7 illustrates the dispenser in an open state, i.e. in a state in which the lid is open such that sheet material can be inserted into the body of the dispenser.

FIG. 7 illustrates the dispenser in an open state, i.e. in a state in which the lid 8 is open such that sheet material 26 can be inserted into the body 1 of the dispenser. Specifically, the lid 8 can be moved from a closed use position into an open refilling position, wherein said refilling position is illustrated in FIG. 7 and will be explained in more detail below.

The body 1 including four side walls 2, 3, 4, and 5 has a rectangular shape when seen in a plan view with two long side walls 3, 5 and two short side walls 2, 4 respectively opposing each other. The lid 8 is pivotally movable about one of the short side walls 4 via a hinge, in particular about an upper end of one of the short side walls 4 of the body 1 of the dispenser. Yet, other configurations are also contemplated. That is, the lid 8 can also be pivotally movable around the upper end of one of the long side walls 3, 5 of the body 1 having a rectangular shape when seen in a plan view.

To support the opening of the lid 8 from the closed use position into the open refilling position, said lid 8 can be supported by a spring (not illustrated), which urges the lid 8 from the closed use position into an open refilling position. Vice versa, the lid 8 may be held in a closed use position by a latch 21, or the like that prevents the lid 8 from freely moving from the closed use position into the open refilling position.

In FIG. 7, the above-described dispenser is in an open state. "Open" in this regard means that the lid 8 is moved from the closed use position into the open refilling position such that sheet material 26, e.g., sheet products in the form of napkins, can be inserted into the inside of the body 1 of the dispenser.

In an alternative (non-illustrated) embodiment, the lid 8 may be configured to be reversibly removable and attachable to the body 1 of the dispenser. In such a configuration, the lid 8 can be put aside for (re-) filling the dispenser (open refilling position) and put back onto the body 1 in order to arrive at the closed use position thereof.

As a first step to load a stack of sheet material 26, which is now described in the example of napkins 26, into the dispenser, the above-described lid 8 is moved from the above-mentioned closed use position into the open refilling position.

Then, the stack of napkins 26 is placed with a bottom face (trailing face) of the stack of napkins 26 on the platform 10 (not illustrated) of the dispenser via the opening 7 of the dispenser, wherein said platform 10 is reciprocally movable within the body 1 of the dispenser, as described above.

Subsequently, a force is exerted on a top face (leading face) of the stack of sheet material opposite to the bottom face (trailing face) to thereby push the platform 10 downward into the body 1 of the dispenser.

Before or after exerting the force on the top face of the stack of the sheet material 26 and before or after placing the stack of napkins 26 with the bottom face of the stack of napkins 26 on the support surface, it may be particularly useful to at least partially fold the leading napkin at least one of its edges. As a result, a so-called starter fold is formed. Such a folding of the leading napkin is illustrated in FIG. 7.

The starter fold enables to easily grasp the leading napkin when the dispenser is freshly refilled.

On top of that, the napkins are usually distributed in bundles (stacks of sheet material) including a predetermined number of sheet material (e.g. napkins). In many cases more than one bundle (stack of sheet material) is inserted into the dispenser during refilling. Whereas the sheet material is usually interfolded within one bundle (stack of sheet material), the trailing sheet material of a first bundle (first stack of sheet material) and the leading sheet material of a second bundle (second stack of sheet material) are not interfolded. As a result, once the trailing sheet material of the first bundle is dispensed during use, the leading sheet material of the second bundle is not automatically withdrawn through the dispensing opening in part for being easily graspable. As a result, it is beneficial to also fold the leading sheet of any bundle (stack of sheet material) inserted into the dispenser in the same manner as described above forming a starter fold.

Even though there is no interfolding at a "stack-break" (also called bundle break), i.e. the transition from one stack of sheet material to another one, a consistent and reliable use of the dispenser can be ensured by at least partially folding the leading napkin 26 of each bundle at least one of its edges (see FIG. 7), and the user is never confronted with any napkin that is hard to grasp.

Afterwards, the lid 8 of the exemplary embodiment is pivoted from the open refilling position into the closed use position again, such that the lid 8 is closed.

Finally, a portion of a leading sheet material 26, i.e. a (partially folded) leading napkin 26 is extracted from the top face of the stack of napkins 26 through the dispensing opening 9 of the lid 8 to thereby dispose that leading napkin. Nevertheless, the extraction of a leading napkin 2 may be carried out with the lid 8 in the closed use position or, alternatively, in an open position.

Accordingly, the stack of napkins 26 can be successfully and easily loaded into the dispenser, and the dispenser is thereby filled with napkins 26.

Figure 8:
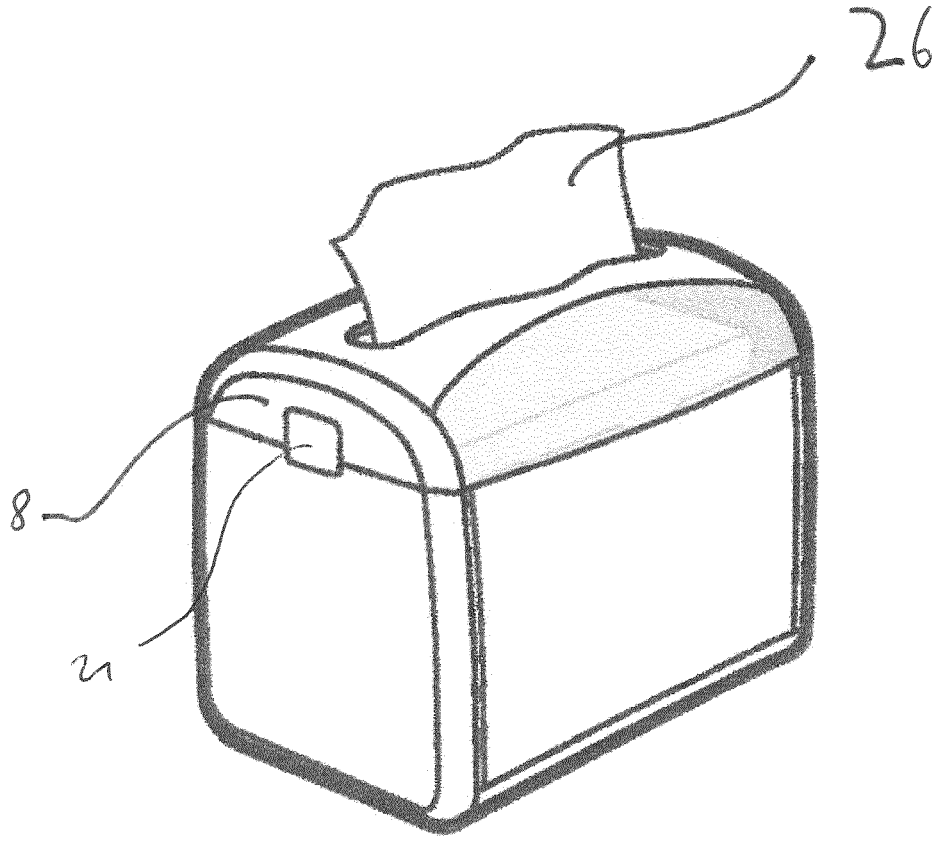
FIG. 8 illustrates the dispenser in a state, in which it is filled with sheet material.

FIG. 8 illustrates the dispenser, which is loaded with a stack of napkins 26. The lid 8 may be at least partially transparent to enable a user to easily gain information on whether napkins 26 are still inside the dispenser or whether the stack of napkins 26 has been emptied therefrom and the dispenser needs to be refilled.

Figure 9:
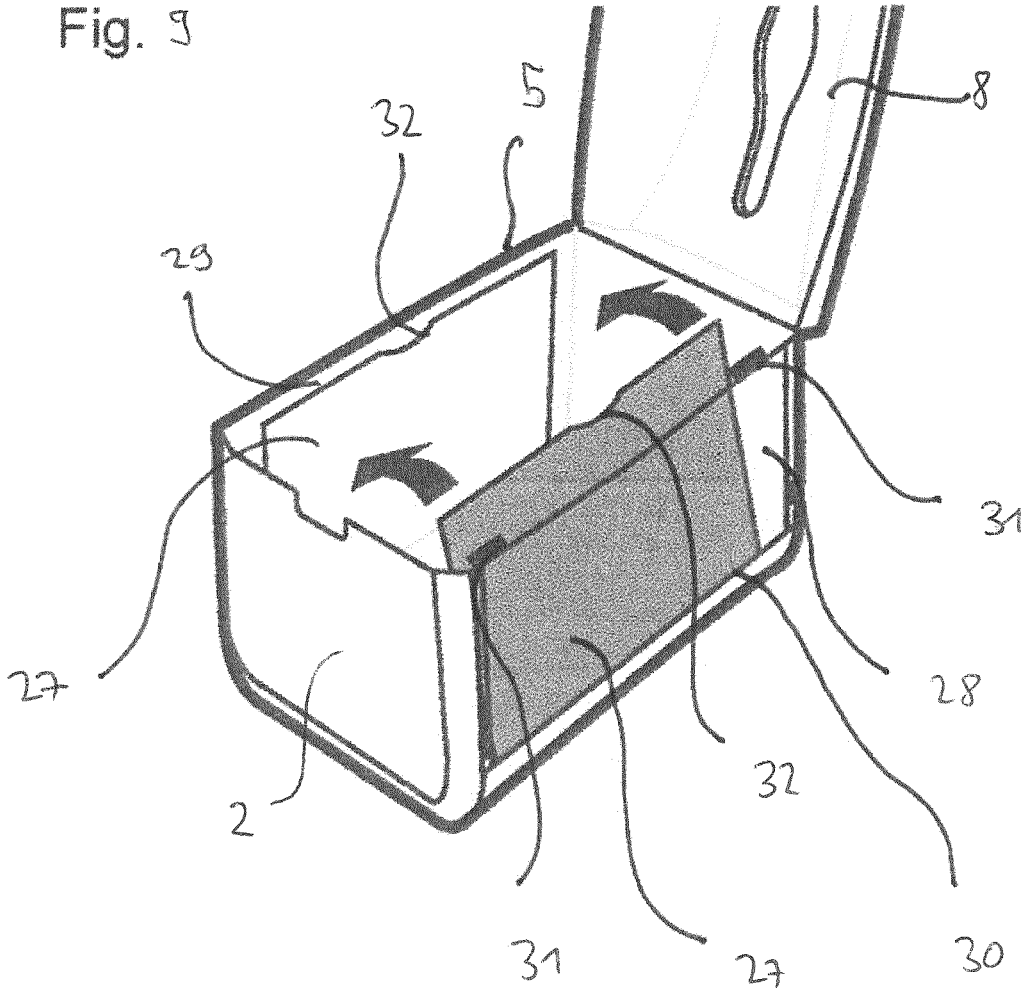
FIG. 9 is an isometric view into the inside of the dispenser.
Figure 10:
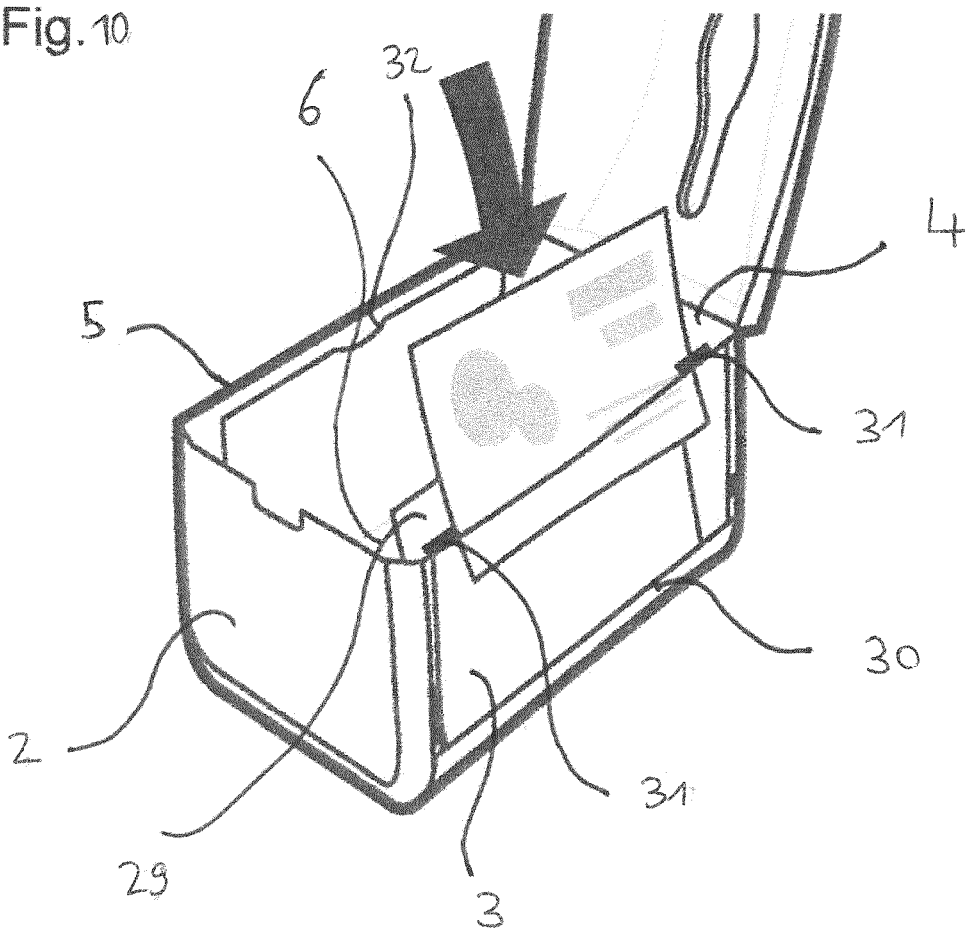
FIG. 10 illustrates how an advertisement, menu, or the like can be inserted into a double-walled side wall of the dispenser according to an embodiment.

With reference to FIGS. 9 and 10, the arrangement inside the dispenser will now be explained in more detail.

FIG. 9 illustrates an isometric view into the inside of the dispenser. As mentioned earlier, said dispenser includes four side walls 2, 3, 4, 5 that are connected to a base 6 and thereby form a box-like shape. In the illustration of FIG. 9, the lid 8 is in an open refilling state to facilitate the explanation of the internal structure of the dispenser. Further, it is at hand that the dispenser illustrated in FIG. 9 is empty, i.e. that no napkins are arranged therein, and the dispenser is not loaded.

As can be taken from FIGS. 9 and 10, the dispenser according to the embodiment includes two double-walled side walls 3, 5 including an inner wall 27 and an outer wall 28. Accordingly, a space 29 is defined between the inner wall 27 and the outer wall 28, respectively.

Nonetheless, it is also possible to provide a dispenser having, e.g., only one double-walled side wall 2, 3, 4, 5 or more than the above-described two double-walled side walls 2, 3, 4, 5.

Subsequently, an example will be described in which two of the opposing side walls 3, 5 are double-walled side walls and wherein said double-walled side walls 3, 5 are arranged on the respective long side walls 3, 5 of the body 1 having a rectangular shape when seen in a plan view.

As used herein, the term "double-walled" and derivatives thereof are not intended to limit the number of layers or "walls" making up a particular side wall. For example, a "double-walled" side wall may refer to a side wall that has three or more walls, but in any case the term "double-walled" refers to a wall that has at least two walls/layers e.g., an inner wall and an outer wall.

In this regard, it should be once again mentioned, that alternative embodiments having two opposing double-walled side walls, e.g., on the short side walls 2, 4 of the body 1 of the dispenser, are contemplated in a similar manner. Similarly, it is also possible to have only one single double-walled side wall on a short side of the body 1 of the dispenser.

As illustrated in FIG. 9 and highlighted by the arrows provided therein, the inner wall 27 of the double-walled side wall 3 is pivotable around a pivot axis 30 toward the inside of the body 1. In the example illustrated in FIGS. 9 and 10, this applies to both of the opposing double-walled side walls 3, 5.

Having an inner wall 27 that is pivotable about the pivot axis 30 toward the inside of the body 1 is realized via hinges that are provided at a lower end of the double-walled side wall 3 adjacent the base 6. For example, the hinges can be provided at the bottom of the double-walled side wall 3, at a position where the side wall 3 contacts the base 6 in order to form the box shape-like body 1 of the dispenser. Accordingly, and as illustrated by the arrows in FIG. 9, the inner wall 27 can be tilted about the pivot axis 30 to open the space 29 being defined between the inner wall 27 and the outer wall 28. By doing so, the inner surface of the outer wall 28 that faces the inside of the body 1 can be easily cleaned. The same applies to the surface of the inner wall 27 that faces the outer wall 28.

Accordingly, the space 29 that is defined between the surface of the inner wall 27 that faces the outer wall 28, and the surface of the outer wall 28 that faces inwardly, i.e., towards the inner wall 27 can be opened in order to allow a user to place a placard or sheet therein.

Such a placard or sheet can be a commercial, an advertisement, a menu of a restaurant, or any other information that may be useful for a user, e.g. a guest, in a restaurant. That placard or sheet may be in printed form or even include some kind of digital display. Yet, said list of functionalities of such a placard or sheet is not limited to the given examples.

In the illustrated embodiment, the pivot axis 30 is arranged at the lower end of the double-walled side wall 3. Yet, in another, not illustrated embodiment, it is also possible that said pivot axis 30 is arranged between the lower end and the upper end of the double-walled side wall 3. That is, a higher pivot axis 30 may be provided such that the inner wall 27 and the outer wall 28 run in parallel to each other below the pivot axis 30 along a vertical direction, and only the part of the inner wall 27 that is arranged about said pivot axis 30 is pivotable, i.e. can be hinged around the pivot axis 30.

To facilitate opening of the space 29, that is, the pivoting of the inner wall 27 away from the outer wall 28, in order to increase the space 29, a recess 32 can be provided. In the embodiment illustrated, e.g., in FIGS. 9 and 10, said recess 32 is provided on an upper end of the inner wall 27, in particular at a centrally located position of the upper end of the inner wall 27. Yet, any other arrangement of said recess 32 is also contemplated. For example, it may also be possible to have a recess 32 on one of the upper corners of the inner wall 27.

To hold the inner wall 27 at a constant distance relative to the outer wall 28 in a use state, that means, in a state in which the inner wall 27 is not tilted toward the inside and the napkin dispenser is in use (as illustrated in FIG. 8), the inner wall 27 can be temporarily fixed to the outer wall 28 via releasable latches 31.

As can be taken from FIGS. 9 and 10, said latches may, for example, be arranged on the upper end of the outer wall 28 of the double-walled side wall 3 of the body 1. Yet, said latch 31 may also be provided, for example, on any other one of the side walls 2, 3, 4, 5, that are not double walled. That means, latches 31 in such an arrangement can also hold the inner wall 27 from the sides to thereby ensure that a constant distance between the inner wall 27 and the outer wall 28 can be achieved. FIGS. 9 and 10 illustrate an example of the latch 31 at a top region of the double-walled side wall 3, in particular on an upper end of the outer wall 28 thereof, thereby making the configuration of the dispenser more compact.

Due to such a configuration, a closed outer surface of the dispenser can be achieved, thereby avoiding gaps on the outer surface of the dispenser in which dust or dirt can accumulate over time. This leads to a more hygienic environment and facilitates cleaning of the dispenser.

The outer wall 28 can be transparent, such that the whole surface of the double-walled side wall 3 of the dispenser can be used for displaying advertisements, menus, or the like. However, it may also be possible to have only a partially transparent outer wall 28, i.e., one in which less than the entirety of the surface of that outer wall 28 is transparent.

In other words, the transparent outer wall 28 may be considered as a window that can be used to display an advertisement, a menu, or the like. Due to the described configuration, the dispenser is closed to the outside and the window, as provided by the outer wall 28, can be accessed from the inside of the dispenser, such that no dust and/or dirt from the outside can enter via potential openings, recesses, or the like that may be provided to access said inside of the window.

Different placards or sheets can be inserted into the two shown double-walled side walls 3, 5 of the body 1 of the dispenser.

To facilitate the understanding on how such a placard or sheet in the example form of an advertisement or a menu of a restaurant can be inserted into the space 29 defined between the inner wall 27 and the outer wall 28, reference is made the FIGS. 9 and 10.

In a first step, the lid 8 of the empty dispenser, is moved from the closed use position to the open refilling position.

Subsequently, the latch 31 is released from the inner wall 27, such that the inner wall 27 can be pivoted inwardly and away from the outer wall 28 (see the arrows in FIG. 9).

In a next step, a sheet can be inserted into the space 29 between the outer wall 28 and the inner wall 27. This is easily possible, because the space 29 was increased by said tilt movement of the inner wall 27 to the inside of the body 1 of the dispenser.

The insertion of the advertisement and/or menu (as an example of the placard or sheet) is illustrated by the arrow in FIG. 10.

Once said sheet is moved completely into the space 29, the system can be closed again, such that the dispenser can be used.

To do so, the inner wall 27 is tilted back towards the outer wall 28. Once the inner wall 27 and the outer wall 28 are both oriented so as to be parallel with each other, a final position is reached, and the inserted sheet is arranged inside the space 29 defined by the inner wall 27 and the outer wall 28. The sheet may be sealed in a space that is defined by the outer wall 28 and the inner wall 27. Then, to lock said closed position of the double-wall side wall 3, the latch 31 is used to fix the inner wall 27 to the outer wall 28 again.

Finally, the dispenser can then be filled with a stack of napkins 26 or can be closed without any napkins 26. To close said dispenser again, the lid 8 is, in a final step, moved from the open refilling position into the closed use position.

Hence, a dispenser can be achieved that displays an advertisement, a menu, or the like without permitting dust or other contaminants to enter through any recesses, gaps, or the like into the dispenser from the outside. In addition, this prevents inadvertent or unauthorized removal of the placard or sheet containing the advertisement, menu, or the like.

LIST OF REFERENCE SIGNS

1 Body
2 Side wall
3 Side wall
4 Side wall
Side wall
6 Base
7 Opening
8 Lid
9 Dispensing opening
Platform
11 Biasing means
12 First arm
13 Top end
14 Base end
15 Second arm
16 Side wall end
17 Locking end
18 Locking portion
19 Engaging portion
20 Slanted surface (of the engaging portion)
21 Latch
22 Pin
23 Pin
24 Hook
25 Circular wall portion (of the base)
26 Sheet material
27 Inner wall
28 Outer wall
29 Space
30 Pivot axis
31 Releasable latches
32 Recess
A Axis of rotation of the first arm
B Axis of rotation of the second arm
C Central axis of the side wall
D Central axis of the base
L1 Length of the engaging portion
L2 Length of the first arm

The invention claimed is:

1. A method for loading a stack of sheet material into a dispenser for dispensing said sheet material, the method comprising:

moving a lid of the dispenser from a closed use position into an open refilling position;

the dispenser comprising:

a body having four side walls, a base, an opening in a top of the body, the lid being for covering the opening in use and enabling access to the opening for refilling, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a spring for urging the platform towards the lid, the spring being attached between a central region of the base and a central region of the platform, a releasable locking mechanism for holding the platform in a locking position in the lowermost position, the releasable locking mechanism comprising:

a first pair of first arms movably attached to one of the side walls and extending in a direction from the top towards the base of the body, wherein one first arm of the first pair of the first arms has a first top end and a first base end, and another first arm of the first pair of the first arms has a second top end and a second base end, a second pair of second arms movably attached to the base and extending in a direction from the side wall to which the first pair of the first arms is attached towards a center of the base, wherein one second arm of the second pair of the second arms has a first side wall end and a first locking end, and another second arm of the second pair of the second arms has a second side wall end and a second locking end, wherein the first side wall end is configured to cooperate with the first base end and the second side wall end is configured to cooperate with the second base end such that a movement of the one first arm and the another first arm respectively causes a movement of the one second arm and the another second arm, the first locking end and the second locking end being configured to releasably interlock respectively with first and second locking portions arranged at the platform to thereby hold the platform in the locking position, wherein the first and second locking portions of the platform are located closer to the central region of the platform than to an edge portion of the platform, wherein the lid has first and second engaging portions at a lower surface thereof, wherein the first and second engaging portions are configured to engage, respectively, with the first top end of the one first arm and the second top end of the another first arm upon closing the lid to thereby release the platform from the locking position;

placing the stack of sheet material via the opening with a trailing face of the stack of sheet material on a supporting surface of the platform;

exerting a force on a leading face of the stack of sheet material opposite to the trailing face to thereby push the platform into the body, in the locking position;

pivoting the lid from the open refilling position into the closed use position to thereby release the platform from the locking position; and extracting a portion of a leading sheet material from the leading face of the stack of sheet material through the dispensing opening of the lid, to thereby dispense the leading sheet material.

2. The method according to claim 1, wherein the first and second locking portions are arranged at a lower side of the platform.

3. The method according to claim 1, wherein the first and second engaging portions protrude from the lower surface of the lid, wherein each of the first and second engaging portions has a length of 1/20 to 1/5 of the length of each of the first pair of the first arms.

4. The method according to claim 1, wherein the body has a box shape with two long side walls and two short side walls respectively opposing each other, wherein the lid is attached to one of the short side walls and the first pair of the first arms is provided on the other one of the short side walls.

5. The method according to claim 1, wherein each of the first pair of the first arms is rotatably attached to the side wall about a respective first axis of rotation and each of the second pair of the second arms is rotatably attached to the base about a respective second axis of rotation.

6. The method according to claim 5, wherein at least one of the first pair of the first arms and the second pair of the second arms is rotatably attached with a spring-loaded mechanism, wherein the spring-loaded mechanism is configured such that the at least one of the first pair of the first arms and the second pair of the second arms rotates about the first or second axis of rotation, respectively, against a biasing force of the spring-loaded mechanism upon bringing the platform in the locking position and/or upon closing the lid.

7. The method according to claim 5, wherein each of the first and second engaging portions has a slanted surface matching with a corresponding slanted surface provided on the top end of the respective first arm.

8. The method according to claim 1, wherein the dispenser has a spring-loaded latch for releasably locking the lid to the body.

9. The method according to claim 1, wherein the lid is moveably attached to at least one of the side walls of the body via a hinge.

10. The method according to claim 1, wherein the lid is configured to be reversibly removable and attachable to the body.

11. A method for loading a stack of sheet material into a dispenser for dispensing said sheet material, the method comprising:

moving a lid of the dispenser from a closed use position into an open refilling position;

the dispenser comprising:

a body having four side walls, a base, an opening in a top of the body, the lid being for covering the opening in use and enabling access to the opening for refilling, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a spring for urging the platform towards the lid, a releasable locking mechanism for holding the platform in a locking position in the lowermost position, the releasable locking mechanism comprising:

a first pair of first arms movably attached to one of the side walls and extending in a direction from the top towards the base of the body, wherein one first arm of the first pair of the first arms has a first top end and a first base end, and another first arm of the first pair of the first arms has a second top end a second base end, a second pair of second arms movably attached to the base and extending in a direction from the side wall to which the first pair of the first arms is attached towards a center of the base, wherein one second arm of the second pair of the second arms has a first side wall end and a first locking end, and another second arm of the second pair of the second arms has a second side wall end and a second locking end, wherein the first side wall end is configured to cooperate with the first base end and the second side wall end is configured to cooperate with the second base end such that a movement of the one first arm and the another first arm respectively causes a movement of the one second arm and the another second arm, the first locking end and the second locking end being configured to releasably interlock respectively with first and second locking portions arranged at the platform to thereby hold the platform in the locking position, wherein the lid has first and second engaging portions at a lower surface thereof, wherein the first and second engaging portions are configured to engage, respectively, with the first top end of the one first arm and the second top end of the another first arm upon closing the lid to thereby release the platform from the locking position;

placing the stack of sheet material via the opening with a trailing face of the stack of sheet material on a supporting surface of the platform;

exerting a force on a leading face of the stack of sheet material opposite to the trailing face to thereby push the platform into the body, in the locking position;

pivoting the lid from the open refilling position into the closed use position to thereby release the platform from the locking position; and extracting a portion of a leading sheet material from the leading face of the stack of sheet material through the dispensing opening of the lid, to thereby dispense the leading sheet material, wherein the locking portions of the platform are symmetrically arranged with respect to a longitudinal axis or a transversal axis of the platform, wherein the first pair of the first arms is symmetrically arranged with respect to a central axis of the one of the side walls, the central axis of the one of the side walls extending in a direction from the top to the base and dividing the one of the side walls into two halves, wherein the second pair of the second arms is symmetrically arranged with respect to a central axis of the base, the central axis of the base extending in a direction from the side wall at which the first pair of the first arms is arranged towards the opposite side wall and dividing the base into two halves.

12. A method for loading a stack of sheet material into a dispenser for dispensing said sheet material, the method comprising:

moving a lid of the dispenser from a closed use position into an open refilling position;

the dispenser comprising:

a body having four side walls, a base, an opening in a top of the body, the lid being configured to cover the opening in use and enabling access to the opening for refilling, wherein the lid has a dispensing opening therein to enable sheet material to be dispensed therefrom, a platform for supporting a plurality of sheet material from below, wherein the platform is movable from a lowermost position when the dispenser is filled with sheet material to an uppermost position adjacent the lid when the dispenser is more nearly empty of sheet material, a spring for urging the platform towards the lid, the spring being attached between a central region of the base and a central region of the platform, and a releasable locking mechanism for holding the platform in a locking position in the lowermost position, the releasable locking mechanism comprising:

a first pair of first arms movably attached to one of the side walls and extending in a direction from the top towards the base of the body, wherein one first arm of the first pair of the first arms has a first top end and a first base end, and another first arm of the first pair of the first arms has a second top end and a second base end, a second pair of second arms movably attached to the base and extending in a direction from the side wall to which the first pair of the first arms is attached towards a center of the base, wherein one second arm of the second pair of the second arms has a first side wall end and a first locking end, and another second arm of the second pair of the second arms has a second side wall end and a second locking end, wherein the first side wall end is configured to cooperate with the first base end and the second side wall end is configured to cooperate with the second base end such that a movement of the one first arm and the another first arm respectively causes a movement of the one second arm and the another second arm, the first locking end and the second locking end being configured to releasably interlock respectively with first and second locking portions arranged at the platform to thereby hold the platform in the locking position, wherein the first and second locking portions of the platform are located closer to the central region of the platform than to an edge portion of the platform, wherein at least one of the side walls is a double-walled side wall comprising an inner wall and an outer wall, a space being defined between the inner wall and the outer wall, and wherein at least part of the inner wall is pivotable around a pivot axis to the inside of the body, wherein the inner wall is fixed to the outer wall via releasable latches;

placing the stack of sheet material via the opening with a trailing face of the stack of sheet material on a supporting surface of the platform;

exerting a force on a leading face of the stack of sheet material opposite to the trailing face to thereby push the platform into the body, in the locking position;

pivoting the lid from the open refilling position into the closed use position to thereby release the platform from the locking position; and extracting a portion of a leading sheet material from the leading face of the stack of sheet material through the dispensing opening of the lid, to thereby dispense the leading sheet material.

13. The method according to claim 12, wherein the pivot axis extends in parallel to the base.

14. The method according to claim 12, wherein the pivot axis is arranged at a lower end of the double walled side wall adjacent the base.

15. The method according to claim 12, wherein the outer wall is at least partially transparent.

16. The method according to claim 12, wherein at least two of the side walls are double-walled side walls, and wherein both inner walls of the respective side walls are pivotable around respective pivot axes to the inside of the body.

17. The method according to claim 16, wherein two opposing side walls are double-walled side walls.

18. The method according to claim 12, wherein the body has a rectangular shape when seen in a plan view with two long side walls and two short side walls respectively opposing each other, wherein the at least one double-walled side wall is arranged on one of the long side walls.

19. The method according to claim 12, wherein the inner wall comprises at least one recess arranged at the upper end thereof.

20. The method according to claim 12, wherein the method further comprises the steps of:

pivoting the inner wall around the pivot axis to the inside of the body;

inserting a sheet into the space being defined between the inner wall and the outer wall; and pivoting the inner wall around the pivot axis to the outer wall of the body.

21. The method according to claim 12, wherein the lid is moveably attached to at least one of the side walls of the body via a hinge.

22. The method according to claim 12, wherein the lid is configured to be reversibly removable and attachable to the body.

* * * * *